US012060778B2

(12) United States Patent
Eitschberger et al.

(10) Patent No.: US 12,060,778 B2
(45) Date of Patent: Aug. 13, 2024

(54) PERFORATING GUN ASSEMBLY

(71) Applicant: DynaEnergetics Europe GmbH, Troisdorf (DE)

(72) Inventors: Christian Eitschberger, Munich (DE); Gernot Uwe Burmeister, Austin, TX (US); Thomas Keller Bradfield, Austin, TX (US); Frank Haron Preiss, Bonn (DE); Thilo Scharf, Letterkenny (IE); Liam McNelis, Bonn (DE)

(73) Assignee: DynaEnergetics Europe Gmbh, Troisdorf (DE)

( * ) Notice: Subject to any disclaimer, the term of this patent is extended or adjusted under 35 U.S.C. 154(b) by 0 days.

(21) Appl. No.: 18/193,874

(22) Filed: Mar. 31, 2023

(65) Prior Publication Data

US 2023/0265747 A1 Aug. 24, 2023

Related U.S. Application Data

(60) Continuation of application No. 17/951,606, filed on Sep. 23, 2022, which is a continuation of application (Continued)

(30) Foreign Application Priority Data

Jul. 18, 2013 (CA) ..... 2821506

(51) Int. Cl.
*E21B 43/1185* (2006.01)
*E21B 43/117* (2006.01)
(Continued)

(52) U.S. Cl.
CPC ..... *E21B 43/1185* (2013.01); *E21B 43/117* (2013.01); *F42B 3/10* (2013.01); *F42B 3/103* (2013.01); *F42B 3/26* (2013.01)

(58) Field of Classification Search
CPC ..... E21B 43/11; E21B 43/116; E21B 43/117; E21B 43/1185; E21B 43/119;
(Continued)

(56) References Cited

U.S. PATENT DOCUMENTS 2,216,359 A 10/1940 Spencer
2,228,873 A 1/1941 Hardt et al.
(Continued)

FOREIGN PATENT DOCUMENTS

CA 2003166 A1 5/1991
CA 2821506 A1 1/2015
(Continued)

OTHER PUBLICATIONS

European Patent Office; Office Action for EP Application No. 20150721178.0; dated Jun. 21, 2022; 4 pages.
(Continued)

*Primary Examiner* — Joshua E Freeman
*Assistant Examiner* — Benjamin S Gomberg
(74) *Attorney, Agent, or Firm* — Womble Bond Dickinson (US) LLP

(57) ABSTRACT

A perforating gun assembly may include a housing extending along a first axis, a movable structure provided within the housing, and a tool string component coupled to the housing and abutting the moveable structure. The movable structure may be movable between a first position along the first axis relative to the housing and a second position along the first axis relative to the housing.

16 Claims, 8 Drawing Sheets

Related U.S. Application Data

No. 16/540,484, filed on Aug. 14, 2019, now Pat. No. 11,648,513, which is a continuation of application No. 16/026,431, filed on Jul. 3, 2018, now Pat. No. 10,507,433, which is a continuation of application No. 15/117,228, filed as application No. PCT/US2015/018906 on Mar. 5, 2015, now Pat. No. 10,188,990, said application No. 16/540,484 is a continuation-in-part of application No. 15/920,812, filed on Mar. 14, 2018, now Pat. No. 11,125,056, which is a continuation of application No. 15/617,344, filed on Jun. 8, 2017, now Pat. No. 10,429,161, which is a division of application No. 15/287,309, filed on Oct. 6, 2016, now Pat. No. 9,702,680, which is a division of application No. 14/904,788, filed as application No. PCT/CA2014/050673 on Jul. 16, 2014, now Pat. No. 9,494,021, application No. 18/193,874 is a continuation of application No. 17/738,184, filed on May 6, 2022.

(60) Provisional application No. 61/949,939, filed on Mar. 7, 2014.

(51) Int. Cl.
*F42B 3/10* (2006.01)
*F42B 3/103* (2006.01)
*F42B 3/26* (2006.01)

(58) Field of Classification Search
CPC ..... E21B 43/1193; F42B 3/10; F42B 3/103; F42B 3/26; F42D 1/00; F42D 1/02; F42D 1/04; F42D 1/041; F42D 1/043; F42D 1/045; F42D 1/22
USPC ..... 89/1.151
See application file for complete search history.

(56) References Cited

U.S. PATENT DOCUMENTS 2,326,406 A 8/1943 Lloyd
2,358,466 A 9/1944 Miller
2,418,486 A 4/1947 Smylie
2,543,814 A 3/1951 Thompson et al.
2,598,651 A 5/1952 Spencer
2,637,402 A 5/1953 Baker et al.
2,640,547 A 6/1953 Baker et al.
2,649,046 A 8/1953 Oliver
2,655,993 A 10/1953 Lloyd
2,692,023 A 10/1954 Conrad
2,734,456 A 2/1956 Sweetman
2,785,631 A 3/1957 Blanchard
2,889,773 A * 6/1959 Staadt ..... E21B 43/116 175/4.6
2,889,775 A * 6/1959 Owen ..... E21B 43/117 175/4.6
2,946,283 A 7/1960 Udry
RE25,407 E 6/1963 Lebourg
3,158,680 A 11/1964 Lovitt et al.
3,170,400 A 2/1965 Nelson
RE25,846 E 8/1965 Campbell
3,246,707 A 4/1966 Bell
3,264,989 A 8/1966 Rucker
3,264,994 A 8/1966 Kurt
3,374,735 A 3/1968 Moore
3,415,321 A 12/1968 Venghiattis
3,504,723 A 4/1970 Cushman et al.
3,565,188 A 2/1971 Hakala
3,859,921 A 1/1975 Stephenson
4,007,790 A 2/1977 Henning
4,007,796 A 2/1977 Boop
4,039,239 A 8/1977 Cobaugh et al.
4,058,061 A 11/1977 Mansur, Jr. et al.
4,080,902 A 3/1978 Goddard et al.
4,107,453 A 8/1978 Erixon
4,132,171 A 1/1979 Pawlak et al.
4,140,188 A 2/1979 Vann
4,172,421 A 10/1979 Regalbuto
4,182,216 A 1/1980 DeCaro
4,208,966 A 6/1980 Hart
4,216,721 A 8/1980 Marziano et al.
4,234,768 A 11/1980 Boop
4,261,263 A 4/1981 Coultas et al.
4,266,613 A 5/1981 Boop
4,290,486 A * 9/1981 Regalbuto ..... E21B 29/02 175/4.6
4,306,628 A 12/1981 Adams, Jr. et al.
4,312,273 A 1/1982 Camp
4,319,526 A 3/1982 DerMott
4,363,529 A 12/1982 Loose
4,485,741 A 12/1984 Moore et al.
4,491,185 A 1/1985 McClure
4,496,008 A 1/1985 Pottier et al.
4,512,418 A 4/1985 Regalbuto et al.
4,523,650 A 6/1985 Sehnert et al.
4,534,423 A 8/1985 Regalbuto
4,537,255 A * 8/1985 Regalbuto ..... E21B 31/1075 166/299
4,541,486 A 9/1985 Wetzel et al.
4,574,892 A * 3/1986 Grigar ..... E21B 43/11855 175/4.51
4,576,233 A 3/1986 George
4,598,775 A 7/1986 Vann et al.
4,609,057 A 9/1986 Walker et al.
4,621,396 A 11/1986 Walker et al.
4,629,001 A 12/1986 Miller et al.
4,650,009 A 3/1987 McClure et al.
4,657,089 A 4/1987 Stout
4,660,910 A * 4/1987 Sharp ..... E21B 17/042 439/194
4,730,793 A 3/1988 Thurber, Jr. et al.
4,744,424 A 5/1988 Lendermon et al.
4,747,201 A 5/1988 Donovan et al.
4,753,170 A 6/1988 Regalbuto et al.
4,762,067 A 8/1988 Barker et al.
4,769,734 A 9/1988 Heinemeyer et al.
4,776,393 A 10/1988 Forehand et al.
4,790,383 A 12/1988 Savage et al.
4,800,815 A 1/1989 Appledom et al.
4,852,494 A 8/1989 Williams
4,869,171 A 9/1989 Abouav
4,889,183 A 12/1989 Sommers et al.
4,986,183 A 1/1991 Jacob et al.
5,001,981 A 3/1991 Shaw
5,006,833 A 4/1991 Marlowe et al.
5,027,708 A 7/1991 Gonzalez et al.
5,038,682 A 8/1991 Marsden
5,052,489 A 10/1991 Carisella et al.
5,060,573 A * 10/1991 Montgomery ..... E21B 29/02 102/275.6
5,070,788 A 12/1991 Carisella et al.
5,088,413 A 2/1992 Huber
5,095,801 A * 3/1992 Lopez de Cardenas ..... E21B 43/118 175/4.53
5,105,742 A 4/1992 Sumner
5,119,729 A 6/1992 Nguyen
5,129,322 A * 7/1992 Christopher ..... F42B 3/28 102/202.3
5,155,293 A 10/1992 Barton
5,155,296 A 10/1992 Michaluk
5,159,145 A * 10/1992 Carisella ..... E21B 43/1185 102/222
5,159,146 A 10/1992 Carisella et al.
5,204,491 A 4/1993 Aureal et al.
5,216,197 A 6/1993 Huber et al.
5,322,019 A 6/1994 Hyland
5,347,929 A 9/1994 Lerche et al.
5,358,418 A 10/1994 Carmichael
5,392,851 A 2/1995 Arend

(56) References Cited

U.S. PATENT DOCUMENTS 5,392,860 A 2/1995 Ross
5,436,791 A * 7/1995 Turano ..... F42D 1/045 175/2
5,503,077 A 4/1996 Motley
5,571,986 A 11/1996 Snider et al.
5,603,384 A 2/1997 Bethel et al.
5,648,635 A 7/1997 Lussier et al.
5,671,899 A 9/1997 Nicholas et al.
5,703,319 A 12/1997 Fritz et al.
5,756,926 A 5/1998 Bonbrake et al.
5,775,426 A 7/1998 Snider et al.
5,778,979 A 7/1998 Burleson et al.
5,785,130 A 7/1998 Wesson et al.
5,816,343 A 10/1998 Markel et al.
5,820,402 A 10/1998 Chiacchio et al.
5,823,266 A 10/1998 Burleson et al.
5,837,925 A 11/1998 Nice
5,911,277 A * 6/1999 Hromas ..... E21B 43/11852 175/4.56
5,992,289 A 11/1999 George et al.
6,006,833 A 12/1999 Burleson et al.
6,012,525 A 1/2000 Burleson et al.
6,085,659 A 7/2000 Beukes et al.
6,112,666 A 9/2000 Murray et al.
6,148,263 A 11/2000 Brooks et al.
6,173,651 B1 1/2001 Pathe et al.
6,263,283 B1 7/2001 Snider et al.
6,298,915 B1 10/2001 George
6,305,287 B1 10/2001 Capers et al.
6,333,699 B1 12/2001 Zierolf
6,354,374 B1 3/2002 Edwards et al.
6,385,031 B1 5/2002 Lerche et al.
6,386,108 B1 5/2002 Brooks et al.
6,408,758 B1 6/2002 Duguet
6,412,388 B1 7/2002 Frazier
6,412,415 B1 7/2002 Kothari et al.
6,418,853 B1 7/2002 Duguet et al.
6,419,044 B1 7/2002 Tite et al.
6,439,121 B1 8/2002 Gillingham
6,467,415 B2 10/2002 Menzel et al.
6,474,931 B1 11/2002 Austin et al.
6,487,973 B1 12/2002 Gilbert, Jr. et al.
6,497,285 B2 12/2002 Walker
6,508,176 B1 1/2003 Badger et al.
6,582,251 B1 6/2003 Burke et al.
6,618,237 B2 9/2003 Eddy et al.
6,651,747 B2 11/2003 Chen et al.
6,659,180 B2 12/2003 Moss
6,719,061 B2 4/2004 Muller et al.
6,739,265 B1 5/2004 Badger et al.
6,742,602 B2 6/2004 Trotechaud
6,752,083 B1 6/2004 Lerche et al.
6,773,312 B2 8/2004 Bauer et al.
6,779,605 B2 8/2004 Jackson
6,843,317 B2 1/2005 Mackenzie
6,851,471 B2 2/2005 Barlow et al.
6,918,334 B2 7/2005 Trotechaud
6,938,689 B2 9/2005 Farrant et al.
7,013,977 B2 3/2006 Nordaas
7,044,230 B2 5/2006 Starr et al.
7,066,261 B2 6/2006 Vicente et al.
7,093,664 B2 8/2006 Todd et al.
7,107,908 B2 9/2006 Forman et al.
7,168,494 B2 1/2007 Starr et al.
7,182,625 B2 2/2007 Machado et al.
7,193,527 B2 3/2007 Hall
7,234,521 B2 6/2007 Shammai et al.
7,237,626 B2 7/2007 Gurjar et al.
7,243,722 B2 7/2007 Oosterling et al.
7,278,491 B2 10/2007 Scott
7,306,038 B2 12/2007 Challacombe
7,347,278 B2 3/2008 Lerche et al.
7,347,279 B2 3/2008 Li et al.
7,353,879 B2 4/2008 Todd et al.
7,357,083 B2 4/2008 Takahara et al.
7,364,451 B2 4/2008 Ring et al.
7,387,162 B2 6/2008 Mooney, Jr. et al.
7,441,601 B2 10/2008 George et al.
7,493,945 B2 2/2009 Doane et al.
7,510,017 B2 3/2009 Howell et al.
7,530,397 B2 * 5/2009 Bell ..... F42D 1/22 102/312
7,540,758 B2 6/2009 Ho
7,568,429 B2 8/2009 Hummel et al.
7,588,080 B2 9/2009 McCoy
7,591,212 B2 9/2009 Myers, Jr. et al.
7,640,857 B2 1/2010 Kneisl
7,726,396 B2 6/2010 Briquet et al.
7,735,578 B2 6/2010 Loehr et al.
7,752,971 B2 7/2010 Loehr
7,762,172 B2 7/2010 Li et al.
7,762,331 B2 7/2010 Goodman et al.
7,762,351 B2 7/2010 Vidal
7,775,279 B2 8/2010 Marya et al.
7,778,006 B2 8/2010 Stewart et al.
7,789,153 B2 9/2010 Prinz et al.
7,810,430 B2 10/2010 Chan et al.
7,901,247 B2 3/2011 Ring
7,908,970 B1 3/2011 Jakaboski et al.
7,929,270 B2 4/2011 Hummel et al.
7,934,453 B2 5/2011 Moore
7,980,874 B2 7/2011 Finke et al.
8,028,624 B2 10/2011 Mattson
8,066,083 B2 11/2011 Hales et al.
8,069,789 B2 12/2011 Hummel et al.
8,074,737 B2 12/2011 Hill et al.
8,091,477 B2 1/2012 Brooks et al.
8,127,846 B2 3/2012 Hill et al.
8,136,439 B2 3/2012 Bell
8,141,434 B2 3/2012 Kippersund et al.
8,151,882 B2 4/2012 Grigar et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,230,788 B2 7/2012 Brooks et al.
8,256,337 B2 9/2012 Hill et al.
8,388,374 B2 3/2013 Grek et al.
8,395,878 B2 3/2013 Stewart et al.
8,413,727 B2 4/2013 Holmes
8,451,137 B2 5/2013 Bonavides et al.
8,576,090 B2 11/2013 Lerche et al.
8,596,378 B2 12/2013 Mason et al.
8,678,666 B2 3/2014 Scadden et al.
8,695,506 B2 4/2014 Lanclos
8,746,144 B2 6/2014 Givens et al.
8,807,003 B2 8/2014 Le et al.
8,833,441 B2 9/2014 Fielder et al.
8,869,887 B2 10/2014 Deere et al.
8,875,787 B2 11/2014 Tassaroli
8,875,796 B2 11/2014 Hales et al.
8,881,816 B2 11/2014 Glenn et al.
8,884,778 B2 11/2014 Lerche et al.
8,943,943 B2 2/2015 Tassaroli
8,960,093 B2 2/2015 Preiss et al.
9,080,433 B2 7/2015 Lanclos et al.
9,145,764 B2 9/2015 Burton et al.
9,194,219 B1 11/2015 Hardesty et al.
9,206,675 B2 12/2015 Hales et al.
9,284,819 B2 3/2016 Tolman et al.
9,284,824 B2 3/2016 Fadul et al.
9,317,038 B2 4/2016 Ozick et al.
9,347,755 B2 5/2016 Backhus et al.
9,359,863 B2 6/2016 Streich et al.
9,383,237 B2 7/2016 Wiklund et al.
9,494,021 B2 11/2016 Parks et al.
9,523,265 B2 12/2016 Upchurch et al.
9,581,422 B2 2/2017 Preiss et al.
9,587,439 B2 3/2017 Lamik-Thonhauser et al.
9,598,942 B2 3/2017 Wells et al.
9,605,937 B2 3/2017 Eitschberger et al.
9,677,363 B2 6/2017 Schacherer et al.
9,689,223 B2 6/2017 Schacherer et al.
9,702,211 B2 7/2017 Tinnen

(56) References Cited

U.S. PATENT DOCUMENTS 10,047,592 B2 8/2018 Burgos et al.
10,077,626 B2 9/2018 Xu et al.
10,077,641 B2 9/2018 Rogman et al.
10,190,398 B2 1/2019 Goodman et al.
10,208,573 B2 2/2019 Kaenel et al.
10,287,873 B2 5/2019 Filas et al.
10,352,144 B2 7/2019 Entchev et al.
D873,373 S 1/2020 Hartman et al.
10,844,696 B2 11/2020 Eitschberger et al.
10,845,178 B2 11/2020 Eitschberger et al.
11,091,987 B1 8/2021 Benker et al.
2002/0020320 A1 2/2002 Lebaudy et al.
2002/0062991 A1 5/2002 Farrant et al.
2003/0000411 A1 1/2003 Cernocky et al.
2003/0001753 A1 1/2003 Cernocky et al.
2003/0041723 A1* 3/2003 Trotechaud ..... E21B 43/1185 89/1.15
2004/0141279 A1 7/2004 Amano et al.
2004/0211862 A1 10/2004 Elam
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0218260 A1 10/2005 Corder et al.
2005/0229805 A1 10/2005 Myers, Jr. et al.
2005/0257710 A1 11/2005 Monetti et al.
2007/0125540 A1 6/2007 Gerez et al.
2007/0158071 A1 7/2007 Mooney, Jr. et al.
2008/0047716 A1 2/2008 McKee et al.
2008/0110612 A1 5/2008 Prinz et al.
2008/0134922 A1 6/2008 Grattan et al.
2008/0149338 A1 6/2008 Goodman et al.
2008/0173204 A1 7/2008 Anderson et al.
2008/0264639 A1 10/2008 Parrott et al.
2009/0050322 A1 2/2009 Hill et al.
2009/0159285 A1 6/2009 Goodman
2009/0272519 A1 11/2009 Green et al.
2009/0272529 A1 11/2009 Crawford
2009/0301723 A1 12/2009 Gray
2010/0000789 A1 1/2010 Barton et al.
2010/0012774 A1 1/2010 Fanucci et al.
2010/0089643 A1 4/2010 Vidal
2010/0096131 A1 4/2010 Hill et al.
2010/0107917 A1 5/2010 Moser
2010/0163224 A1 7/2010 Strickland
2010/0230104 A1 9/2010 Nölke et al.
2010/0286800 A1 11/2010 Lerche et al.
2011/0024116 A1 2/2011 McCann et al.
2011/0042069 A1 2/2011 Bailey et al.
2011/0301784 A1 12/2011 Oakley et al.
2012/0006217 A1 1/2012 Anderson
2012/0085538 A1 4/2012 Guerrero et al.
2012/0094553 A1 4/2012 Fujiwara et al.
2012/0160483 A1 6/2012 Carisella
2012/0199031 A1 8/2012 Lanclos
2012/0199352 A1* 8/2012 Lanclos ..... E21B 43/1185 166/65.1
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli et al.
2013/0008669 A1 1/2013 Deere et al.
2013/0043074 A1 2/2013 Tassaroli
2013/0062055 A1 3/2013 Tolman et al.
2013/0098257 A1 4/2013 Goodridge et al.
2013/0118342 A1 5/2013 Tassaroli
2013/0125772 A1* 5/2013 Backhus ..... F42B 3/10 102/206
2013/0199843 A1 8/2013 Ross
2013/0220613 A1 8/2013 Brooks et al.
2013/0248174 A1 9/2013 Dale et al.
2013/0256464 A1 10/2013 Belik et al.
2014/0033939 A1 2/2014 Priess et al.
2014/0053750 A1 2/2014 Lownds et al.
2014/0131035 A1 5/2014 Entchev et al.
2015/0176386 A1 6/2015 Castillo et al.
2015/0226044 A1 8/2015 Ursi et al.
2015/0330192 A1 11/2015 Rogman et al.
2016/0050724 A1 2/2016 Moon et al.
2016/0061572 A1 3/2016 Eitschberger et al.
2016/0084048 A1 3/2016 Harrigan et al.
2016/0168961 A1 6/2016 Parks et al.
2016/0333675 A1 11/2016 Wells et al.
2016/0365667 A1 12/2016 Mueller et al.
2017/0030693 A1 2/2017 Preiss et al.
2017/0032653 A1 2/2017 Crawford et al.
2017/0268320 A1 9/2017 Angman et al.
2017/0276465 A1 9/2017 Parks et al.
2017/0298716 A1 10/2017 McConnell et al.
2018/0202789 A1 7/2018 Parks et al.
2020/0199983 A1 6/2020 Preiss et al.
2020/0332630 A1 10/2020 Davis et al.
2021/0164331 A1 6/2021 Sokolove et al.
2021/0222525 A1* 7/2021 Dyess ..... F42B 3/02
2022/0154560 A1 5/2022 Eitschberger et al.
2022/0170727 A1 6/2022 Eitschberger
2022/0258103 A1 8/2022 Eitschberger et al.
2022/0307330 A1 9/2022 Eitschberger et al.
2023/0008361 A1* 1/2023 Lowe ..... E21B 43/1185

FOREIGN PATENT DOCUMENTS

CA 2824838 A1 2/2015
CA 2888787 A1 10/2015
CA 2821506 C 3/2020
CN 85107897 A 9/1986
CN 2661919 12/2004
CN 2821154 9/2006
CN 101397890 A 4/2009
CN 101691837 B 4/2010
CN 201620848 U 11/2010
CN 201764910 U 3/2011
CN 102878877 A 1/2013
CN 103993861 A 8/2014
DE 102005031673 A1 3/2006
DE 102007007498 10/2015
EP 0088516 A1 9/1983
EP 0207749 A2 1/1987
EP 0416915 A2 3/1991
EP 0180520 B1 5/1991
EP 679859 A2 11/1995
EP 694157 B1 8/2001
EP 2702349 B1 11/2015
EP 2310616 B1 10/2017
GB 2404291 A 1/2005
JP 2003329399 A 11/2003
RU 2295694 C2 3/2007
RU 93521 U1 4/2010
RU 100552 U1 12/2010
RU 2434122 C2 11/2011
RU 2633904 C1 10/2017
WO 9721067 A1 6/1997
WO 9745696 A1 12/1997
WO 1998046965 A1 10/1998
WO 9905390 A1 2/1999
WO 0123827 A1 4/2001
WO 0133029 A3 5/2001
WO 0159401 A1 8/2001
WO 2001059401 A1 8/2001
WO 2002099356 A2 12/2002
WO 2009091422 A2 7/2009
WO 2009091422 A3 3/2010
WO 2011160099 A1 12/2011
WO 2012006357 A2 1/2012
WO 2012135101 A2 10/2012
WO 2012106640 A3 11/2012
WO 2012149584 A1 11/2012
WO 2014046670 A1 3/2014
WO 2015006869 A1 1/2015
WO 2015134719 A1 9/2015
WO 2016100269 A1 6/2016
WO 2019147294 A1 8/2019

(56) References Cited

FOREIGN PATENT DOCUMENTS

| | | | |
|---|---|---|---|
| WO | 2020112983 | A1 | 6/2020 |
| WO | 2020200935 | A1 | 10/2020 |
| WO | 2021025716 | A1 | 2/2021 |
| WO | 2021116336 | A1 | 6/2021 |
| WO | 2021116338 | A1 | 6/2021 |
| WO | 2021122797 | A1 | 6/2021 |
| WO | 2022184654 | A1 | 9/2022 |
| WO | 2022184731 | A1 | 9/2022 |
| WO | 2022184732 | A1 | 9/2022 |

OTHER PUBLICATIONS

G&H Diversified Manufacturing, LP; Petitioner's Oral Argument Presentation for PGR No. PGR2021-00078; dated Jul. 26, 2022; 65 pages.
Hunting Titan, Inc.; Defendant Hunting Titan, Inc.'s Opposition to Plaintiff's Motion for Summary Judgement for Civil Action No. 4:20-cv-02123; dated Mar. 30, 2022; 37 pages.
Hunting Titan, Inc.; Defendant Hunting Titan, Inc.'s Opposed Motion for Leave to Amend Invalidity Contentions for Civil Action No. 4:20-cv-02123; dated Nov. 19, 2021; 17 pages.
Hunting Titan, Inc.; Defendant's Final Invalidity Contentions for Civil Action No. 4:20-cv-02123; dated Jan. 7, 2022; 54 pages.
Hunting Titan, Inc.; Defendant's Preliminary Invalidity Contentions for Civil Action No. 4:20-cv-02123; dated Aug. 6, 2021; 52 pages.
Hunting Titan, Inc.; Exhibit 1 to Defendant Hunting Titan, Inc.'s Opposed Motion for Leave to Amend Invalidity Contentions for Civil Action No. 4:20-cv-02123; dated Nov. 19, 2021; 64 pages.
Hunting Titan, Inc.; Exhibit 2 to Defendant Hunting Titan, Inc.'s Opposed Motion for Leave to Amend Invalidity Contentions for Civil Action No. 4:20-cv-02123; dated Nov. 19, 2021; 33 pages.
Hunting Titan, Inc.; Exhibit 3 to Defendant Hunting Titan, Inc.'s Opposed Motion for Leave to Amend Invalidity Contentions for Civil Action No. 4:20-cv-02123; dated Nov. 19, 2021; 24 pages.
Hunting Titan, Inc.; Exhibit A to Defendant's Preliminary Invalidity Contentions, Invalidity of U.S. Pat. No. 10,429,161; dated Aug. 6, 2021; 93 pages.
Hunting Titan, Inc.; Exhibit B to Defendant's Preliminary Invalidity Contentions, Invalidity of U.S. Pat. No. 10,472,938; dated Aug. 6, 2021; 165 pages.
Hunting Titan, Inc.; Exhibit C to Defendant's Final Invalidity Contentions, Invalidity of U.S. Pat. No. 10,429,161; dated Jan. 7, 2022; 3 pages.
Hunting Titan, Inc.; Exhibit D to Defendant's Final Invalidity Contentions, Invalidity of U.S. Pat. No. 10,472,938; dated Jan. 7, 2022; 6 pages.
International Searching Authority; International Preliminary Report on Patentability of the International Searching Authority for PCT/EP2020/085622; mailed on Jun. 23, 2022; 7 pages.
International Searching Authority; International Search Report and Written Opinion of the International Searching Authority for PCT/EP2022/055014; mailed on Jul. 4, 2022; 17 pages.
International Searching Authority; International Search Report and Written Opinion of the International Searching Authority for PCT/EP2022/055191; mailed on May 20, 2022; 10 pages.
SWM International, LLC and Nextier Completion Solutions Inc; Petitioner's Reply to Patent Owner's Response to Petition for Case No. PGR2021-00097; dated Jul. 29, 2022; 36 pages.
United States District Court for the Southern District of Texas; Memorandum Opinion and Order for Civil Action No. H-20-2123; dated Sep. 19, 2022; 115 pages.
United States Patent and Trademark Office; Non-Final Office Action for U.S. Appl. No. 17/007,574; dated May 6, 2022; 10 pages.
United States Patent and Trademark Office; Notice of Allowance for U.S. Appl. No. 17/358,101; dated Oct. 26, 2022; 8 pages.
Nextier Completion Solutions Inc.; Defendant's Preliminary Invalidity Contentions for Civil Action No. 6:20-cv-01201-ADA; dated Aug. 30, 2021; 21 pages.
Nextier Completion Solutions Inc.; Exhibit A-9 Selective perforation: A Game Changer in Peforating Technology—Case Study; dated Aug. 30, 2021; 13 pages.
Nextier Completion Solutions; Plaintiffs Preliminary Invalidity Contentions for Civil Action No. 4:21-cv-01328; dated Jun. 30, 2021; 19 pages.
Nextier Oilfield Solutions Inc; Petition for Inter Partes Review No. IPR2021-00082; dated Oct. 21, 2020; 111 pages.
Nexus Perforating LLC; Answer to DynaEnergetics Europe GmbH and DynaEnergetics US Inc/'s Complaint and Counterclaims; dated Apr. 15, 2021; 10 pages.
Nexus Perforating LLC; Complaint and Demand for Jury Trial for Civil Case No. 4:20-cv-01539; dated Apr. 30, 2020; 11 pages.
Nexus Perforating LLC; Invalidity Contentions for Civil Action No. 4:21-cv-00280; dated Jun. 30, 2021; 44 pages.
Nexus Perforating LLC; Nexus Preliminary Claim Construction and Extrinsic Evidence for Civil Action No. 4:21-cv-00280; dated Aug. 4, 2021; 6 pages.
Nexus Perforating; Double Nexus Connect (Thunder Gun System) Description; Retrieved from the internet Jan. 27, 2021; 6 pages.
Norwegian Industrial Property Office; Notice of Allowance for NO Application No. 20171759; dated Apr. 23, 2021; 2 pages.
Norwegian Industrial Property Office; Office Action and Search Report for NO App. 20160017; Jun. 15, 2017; 5 pages.
Norwegian Industrial Property Office; Office Action and Search Report for NO App. No. 20171759; Jan. 14, 2020; 6 pages.
Norwegian Industrial Property Office; Office Action for NO Appl. No. 20160017; mailed Dec. 4, 2017; 2 pages.
Norwegian Industrial Property Office; Office Action for NO Application No. 20210799; dated Oct. 30, 2021; 2 pages.
Norwegian Industrial Property Office; Opinion for NO Appl. No. 20171759; mailed Apr. 5, 2019; 1 page.
Oilfield Glossary; Definition of Perforating Gun; dated Feb. 26, 2013; 2 pages.
oilgasglossary.com; Definition of "sub"; dated Nov. 20, 2008; 1 page.
Olsen, Steve; Declaration regarding the SafeJet System for PGR2021-00097; dated Jul. 16, 2021; 25 pages.
Orlca, Uni Tronic 600 Electronic Blasting System, Technical Data Sheet, Jun. 19, 2016, 2 pgs., www.oricaminingservices.com/download/file_id_19567/.
OSO Perforating, LLC; Defendant's Preliminary Invalidity Contentions for Civil Action No. 3:21-cv-00188-M; dated Aug. 4, 2021; 23 pages.
OSO Perforating, LLC; Exhibit A1 U.S. Pat. No. 5,155,293 to Barton vs. Asserted Claims of U.S. Pat. No. 10,844,697; dated Aug. 4, 2021; 21 pages.
Owen Oil Tools & Pacific Scientific; RF-Safe Green Det, Side Block for Side Initiation, Jul. 26, 2017, 2 pgs.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.com/owen/cms/docs/Canada/10A_erhsc-01.0-c.pdf.
Owen Oil Tools, Recommended Practice for Oilfield Explosive Safety, Presented at 2011 MENAPS Middle East and North Africa Perforating Symposium, Nov. 28-30, 2011, 6 pages.
Owen Oil Tools; CoreLab Safe Ignition System Owen Det Bodies; dated 2015; 12 pages.
Owens Oil Tools, E & B Select Fire Side Port Tandem Sub Assembly Man-30-XXX-0002-96, revised Dec. 2012, 9 pgs., https://www.corelab.com/owen/CMS/docs/Manuals/gunsys/MAN-30-XXX-0002-96-R00.pdf.
Parrot, Robert; Declaration, PGR 2020-00080; dated Aug. 11, 2020; 400 pages.
Parrott, Robert A.; Declaration in Support of PGR20201-00089; dated Jun. 1, 2021; 353 pages.
Parrott, Robert; Declaration for IPR2021-00082; dated Oct. 20, 2020; 110 pages.
Parrott, Robert; Declaration for PGR No. 2021-00078; dated May 10, 2021; 182 pages.

(56) References Cited

OTHER PUBLICATIONS

Patent Trial and Appeal Board; Decision Granting Patent Owner's Request for Rehearing and Motion to Amend for IPR2018-00600; dated Jul. 6, 2020; 27 pages.
Patent Trial and Appeals Board; Decision Granting Institution of Post Grant Review, PGR No. PGR2021-00097; dated Jan. 6, 2022; 92 pages.
Perforating Services Catalog 2008 part 2 of 2; Exhibit 1020 of PGR No. 2021-00089; dated 2008; 239 pages.
PerfX Wireline Services, LLC; PerfX Wireline Services, LLC's Preliminary Invalidity Contentions for Civil Action No. 1:20-CV-03665; dated Jul. 2, 2021; 4 pages.
PerfX Wireline Services, LLC; Defendant PerfX Wireline Services, LLC's Opening Claim Construction Brief; dated Oct. 18, 2021; 23 pages.
PerfX Wireline Services, LLC; Invalidity Chart for U.S. Pat. No. 10,844,697 in view of the Dynawell Gun System Exhibit A; dated Jul. 2, 2021; 42 pages.
PerfX Wireline Services, LLC; Invalidity Chart for U.S. Pat. No. 10,844,697 in view of the LRI Gun System Exhibit B; dated Jul. 2, 2021; 33 pages.
PerfX Wireline Services, LLC; Invalidity Chart for U.S. Pat. No. 10,844,697 in view of the Owen Oil Tools System Exhibit C; dated Jul. 2, 2021; 64 pages.
PerfX Wireline Services, LLC; Invalidity Chart for U.S. Pat. No. 10,844,697 in view of the Select Fire System Exhibit D; dated Jul. 2, 2021; 49 pages.
PerfX Wireline Services, LLC; Invalidity Chart for U.S. Pat. No. 10,844,697 in view of U.S. Pat. No. 10,077,641 Exhibit H; dated Jul. 2, 2021; 41 pages.
PerfX Wireline Services, LLC; Invalidity Chart for U.S. Pat. No. 10,844,697 in view of U.S. Pat. No. 4,007,796 Exhibit F; dated Jul. 2, 2021; 40 pages.
PerfX Wireline Services, LLC; Invalidity Chart for U.S. Pat. No. 10,844,697 in view of U.S. Pat. No. 5,042,594 Exhibit E; dated Jul. 2, 2021; 38 pages.
PerfX Wireline Services, LLC; Invalidity Chart for U.S. Pat. No. 10,844,697 in view of U.S. Pat. No. 9,145,764 Exhibit G; dated Jul. 2, 2021; 58 pages.
PerfX's Wireline Services, LLC; Exhibit A-1: Invalidity Chart for U.S. Pat. No. 10,844,697 in view of the Dynawell Gun System; dated Aug. 30, 2021; 30 pages.
PerfX's Wireline Services, LLC; Exhibit A-2: Invalidity Chart for U.S. Pat. No. 10,844,697 in view of the LRI Gun System; dated Aug. 30, 2021; 29 pages.
PerfX's Wireline Services, LLC; Exhibit A-3: Invalidity Chart for U.S. Pat. No. 10,844,697 in view of the Owen Dil Tools System; dated Aug. 30, 2021; 42 pages.
PerfX's Wireline Services, LLC; Exhibit A-4: Invalidity Chart for U.S. Pat. No. 10,844,697 in view of the Select Fire System; dated Aug. 30, 2021; 32 pages.
PerfX's Wireline Services, LLC; Exhibit A-5: Invalidity Chart for U.S. Pat. No. 10,844,697 in view of U.S. Pat. No. 5,042,594; dated Aug. 30, 2021; 27 pages.
PerfX's Wireline Services, LLC; Exhibit A-6: Invalidity Chart for U.S. Pat. No. 10,844,697 in view of U.S. Pat. No. 4,007,796; dated Aug. 30, 2021; 23 pages.
Horizontal Wireline Services, LLC and Allied Wireline Services, LLC; Exhibit A5 U.S. Pat. No. 9,175,553 to *Mcann, et al.* vs. *Asserted Claims of U.S. Pat. No. 10,844,697*; dated Aug. 30, 2021; 26 pages.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Titan Gun System Catalog; Exhibit No. 1035 of PGR No. 2021-00078; 59 pages.
Hunting Titan Inc.; Petition for Post Grant Review of U.S. Pat. No. 10,429,161; dated Jun. 30, 2020; 109 pages.
Hunting Titan Inc.; Petition for Post Grant Review of U.S. Pat. No. 10,472,938; dated Aug. 12, 2020; 198 pages.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan Ltd.; Defendants Invalidity Contentions Pursuant to Patent Rule 3-3, Civil Action No. 4:17-cv-03784; dated Jul. 6, 2018; 29 pages.
Hunting Titan Ltd.; Defendants' Objections and Responses to Plaintiffs' First Set of Interrogatories, Civil Action No. 4:17-cv-03784; dated Jun. 11, 2018.
Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.
Hunting Titan, H-1 Perforating System, Sep. 1, 2017, 3 pgs., http://www.hunting-intl.com/titan/perforating-guns-and-setting-tools/h-1%C2%AE-perforating-system.
Hunting Titan, Inc.; Defendant's Answer, Affirmative Defenses, and Counterclaims to Plaintiffs' Second Amended Complaint for Civil Action No. 4:20-cv-02123; dated Sep. 10, 2021; 77 pages.
Hunting Titan, Inc.; Defendant's Responsive Claim Construction Brief for Civil Action No. 4:20-cv-02123; dated Oct. 1, 2021; 31 pages.
Hunting Titan, Inc.; Defendant's Supplemental Brief on Claim Construction; dated Nov. 5, 2021; 9 pages.
Hunting Titan, Inc; Petitioner's Sur-Reply on Patent Owner's Motion to Amend for IPR No. 2018-00600; dated Apr. 11, 2019; 17 pages.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Hunting Titan; ControlFire; dated Jan. 5, 2017; 20 pages; http://www.hunting-intl.com/media/2666029/Hunting%20ControlFire%20Presentation_Public11.pdf.
Hunting Wireline Hardware Brochures; Exhibit No. 1025 of PGR No. 2021-00078; dated 2013; 27 pages.
Hunting; Payload: Preloaded Perforating Guns; 2 pages; http://www.hunting-intl.com/titan/perforating-guns/payload-preloaded-perforating-guns.
Industrial Property Office, Czech Republic; Office Action for CZ App. No. PV 2017-675; Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; Oct. 26, 2018; 2 pages.
Industrial Property Office, Czech Republic; Office Action; CZ App. No. PV 2017-675; Dec. 17, 2018; 2 pages.
Intellectual Property India, Office Action of IN Application No. 201647004496, dated Jun. 7, 2019, 6 pgs.
International Searching Authority, International Preliminary Report on Patentability for PCT App. No. PCT/EP2014/065752; Mar. 1, 2016, 10 pgs.
International Searching Authority; International Preliminary Report on Patentability for PCT Appl. No. PCT/CA2014/050673; issued Jan. 19, 2016; 5 pages.
International Searching Authority; International Preliminary Report on Patentability of the International Searching Authority for PCT/EP2020/075788; mailed on Mar. 31, 2022; 10 pages.
International Searching Authority; International Search Report and Written Opinion for International Application No. PCT/US2020/032879; dated Aug. 20, 2020; 9 pages.

(56) References Cited

OTHER PUBLICATIONS

International Searching Authority; International Search Report and Written Opinion for PCT App. No. PCT/CA2014/050673; mailed Oct. 9, 2014; 7 pages.
International Searching Authority; International Search Report and Written Opinion for PCT App. No. PCT/EP2015/059381; Nov. 23, 2015; 14 pages.
International Searching Authority; International Search Report and Written Opinion for PCT App. No. PCT/US2015/018906; Jul. 10, 2015; 12 pages.
International Searching Authority; International Search Report and Written Opinion for PCT Application No. EP2020066327; mailed on Jan. 11, 2021; 17 pages.
International Searching Authority; Invitation to Pay Additional Fees with Partial International Search for Application No. PCT/EP2020/075788; Mailed on Jan. 19, 2021; 9 pages.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Jet Research Centers, Capsule Gun Perforating Systems, Alvarado, Texas, 27 pgs., Jun. 12, 2019 https://www.jetresearch.com/content/dam/jrc/Documents/Books_Catalogs/07_Cap_Gun.pdf.
Johnson, Bryce; Citation of Prior Art and Written Statements in Patent Files for U.S. Pat. No. 10,844,697; dated Apr. 29, 2021; 2 pages.
Johnson, Bryce; Rule 501 citation of prior art and written "claim scope statements" in U.S. Pat. No. 10,844,697; dated Apr. 29, 2021; 18 pages.
JPT; New Instrumented Docketing Gun System Maximizes Perforating Performance; dated Aug. 31, 2018 7 pages; https://jpt.spe.org/new-instrumented-docking-gun-system-maximizes-perforating-performance.
Logan, et al.; International Patent Application No. PCT/CA2013/050986; dated Dec. 18, 2013; 54 pages.
Markel, Dan; Declaration regarding the SafeJet System for PGR2021-00097; dated Jul. 15, 2021; 21 pages.
Mcbride Michael; Declaration for IPR2021-00082; dated Oct. 20, 2020; 3 pages.
Mcnelis et al.; High-Performance Plug-and-Perf Completions in Unconventional Wells; Society of Petroleum Engineers Annual Technical Conference and Exhibition; Sep. 28, 2015.
Meehan, Nathan; Declaration of D. Nathan Meehan, Ph.D, P.E; dated Oct. 18, 2021; 86 pages.
merriam-webster.com, Insulator Definition, https://www.merriam-webster.com/dictionary/insulator, Jan. 31, 2018, 4 pages.
New Oxford American Dictionary Third Edition; Definition of "end"; dated 2010; 3 pages.
Nextier Completion Solutions Inc.; Defendant NexTier Completion Solution Inc.'s Opening Claim Construction Brief; dated Oct. 18, 2021; 26 pages.
Nextier Completion Solutions Inc.; Defendant Nextier Completion Solutions Inc.'s First Amended Answer and Counterclaims to Plaintiffs' First Amended Complaint for Civil Action No. 6:20-CV-01201; dated Jun. 28, 2021; 17 pages.
G&H Diversified Manufacturing, LP; Defendants' Preliminary Invalidity Contentions for Civil Action No. 3:20-cv-00376; dated May 6, 2021; 20 pages.
G&H Diversified Manufacturing, LP; Plaintiff and Counterclaim Defendant G&H Diversified Manufacturing, LP and Counterclaim Defendant Yellow Jacket Oil Tools, LLC's First Supplemental Proposed Constructions; dated Jun. 24, 2021; 7 pages.
G&H Diversified Manufacturing, LP; Plaintiff and Counterclaim Defendant G&H Diversified Manufacturing, LP and Counterclaim Defendant Yellow Jacket Oil Tools, LLC's Proposed Constructions; dated Jun. 10, 2021; 7 pages.
G&H Diversified Manufacturing, LP; Redated Petition for Post Grant Review for PGR2021-00078; dated May 10, 2021; 20 pages.
G&H Diversified Manufacturing, LP; Reply to Preliminary Response for PGR No. PGR2021-00078; dated Sep. 14, 2021; 18 pages.
GB Intellectual Property Office, Combined Search and Examination Report for GB App. No. 1717516.7, dated Feb. 27, 2018, 6 pgs.
GB Intellectual Property Office, Combined Search and Examination Report for GB App. No. GB1700625.5, dated Jul. 7, 2017, 5 pages.
GB Intellectual Property Office, Examination Report for GB App. No. GB1600085.3, mailed Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; Apr. 13, 2018; 3 pages.
GB Intellectual Property Office; Notification of Grant for GB Appl. No. 1717516.7; Oct. 9, 2018; 2 pages.
GB Intellectual Property Office; Office Action for GB App. No. 1717516.7; dated Feb. 27, 2018; 6 pages.
GB Intellectual Property Office; Search Report for GB. Appl. No. 1700625.5; mailed Dec. 21, 2017; 5 pages.
Geodynamics; Perforating Catalog; dated Mar. 5, 2020; 218 pages; https://www.perf.com/hubfs/PDF%20Files/PerforatingCatalog_03272020_SMS.pdf.
German Patent Office, Office Action for German Patent Application No. 10 2013 109 227.6, which is in the same family as PCT Application No. PCT/EP2014/065752, see p. 5 for references cited, May 22, 2014, 8 pgs.
Gilliat et al.; New Select-Fire System: Improved Reliability and Safety in Select Fire Operations; 2012; 16 pgs.
GR Energy Operating GP LLC, GR Energy Services Management, LP and GR Energy Services, LLC; Exhibit A U.S. Pat. No. 10,844,697 vs Castel; dated Aug. 30, 2021; 88 pages.
GR Energy Operating GP LLC, GR Energy Services Management, LP and GR Energy Services, LLC; Exhibit B U.S. Pat. No. 10,844,697 vs Goodman; dated Aug. 30, 2021; 36 pages.
GR Energy Operating GP LLC, GR Energy Services Management, LP and GR Energy Services, LLC; Exhibit C U.S. Pat. No. 10,844,697 vs Hromas; dated Aug. 30, 2021; 27 pages.
GR Energy Operating GP LLC, GR Energy Services Management, LP and GR Energy Services, LLC; Exhibit D U.S. Pat. No. 10,844,697 vs Boop 768; dated Aug. 30, 2021; 35 pages.
GR Energy Operating GP LLC, GR Energy Services Management, LP and GR Energy Services, LLC; Exhibit E U.S. Pat. No. 10,844,697 vs Boop 792; dated Aug. 30, 2021; 52 pages.
GR Energy Operating GP LLC, GR Energy Services Management, LP and GR Energy Services, LLC; Exhibit F U.S. Pat. No. 10,844,697 vs Boop 378; dated Aug. 30, 2021; 34 pages.
GR Energy Operating GP LLC, GR Energy Services Management, LP and GR Energy Services, LLC; Exhibit G U.S. Pat. No. 10,844,697 vs Bickford; dated Aug. 30, 2021; 7 pages.
GR Energy Operating GP LLC, GR Energy Services Management, LP and GR Energy Services, LLC; Exhibit H U.S. Pat. No. 10,844,697 vs Black; dated Aug. 30, 2021; 33 pages.
GR Energy Operating GP LLC, GR Energy Services Management, LP and GR Energy Services, LLC; Exhibit I U.S. Pat. No. 10,844,697 vs Rogman; dated Aug. 30, 2021; 59 pages.
GR Energy Operating GP LLC, GR Energy Services Management, LP and GR Energy Services, LLC; Exhibit J U.S. Pat. No. 10,844,697 vs Burton; dated Aug. 30, 2021; 57 pages.
GR Energy Operating GP LLC, GR Energy Services Management, LP and GR Energy Services, LLC; Exhibit K U.S. Pat. No. 10,844,697 vs Borgfeld; dated Aug. 30, 2021; 36 pages.
GR Energy Operating GP LLC, GR Energy Services Management, LP and GR Energy Services, LLC; Exhibit L U.S. Pat. No. 10,844,697 vs Boop '383; dated Aug. 30, 2021; 24 pages.
GR Energy Operating GP LLC, GR Energy Services Management, LP and GR Energy Services, LLC; Exhibit M U.S. Pat. No. 10,844,697 vs Boop '992; dated Aug. 30, 2021; 14 pages.
GR Energy Operating GP LLC, GR Energy Services Management, LP and GR Energy Services, LLC; Exhibit N U.S. Pat. No. 10,844,697 vs Deere; dated Aug. 30, 2021; 14 pages.
GR Energy Operating GP LLC, GR Energy Services Management, LP and GR Energy Services, LLC; Exhibit O U.S. Pat. No. 10,844,697 vs Harrigan Provisional; dated Aug. 30, 2021; 26 pages.

(56) References Cited

OTHER PUBLICATIONS

GR Energy Operating GP LLC, GR Energy Services Management, LP and GR Energy Services, LLC; Exhibit P U.S. Pat. No. 10,844,697 vs Burke '251; dated Aug. 30, 2021; 7 pages.
GR Energy Operating GP LLC, GR Energy Services Management, LP and GR Energy Services, LLC; Exhibit Q U.S. Pat. No. 10,844,697 vs Runkel; dated Aug. 30, 2021; 7 pages.
GR Energy Operating GP LLC, GR Energy Services Management, LP and GR Energy Services, LLC; Exhibit R U.S. Pat. No. 10,844,697 vs Tassaroli; dated Aug. 30, 2021; 10 pages.
GR Energy Operating GP LLC, GR Energy Services Management, LP and GR Energy Services, LLC; Exhibit S U.S. Pat. No. 10,844,697 vs Harrigan '048; dated Aug. 30, 2021; 7 pages.
GR Energy Operating GP LLC, GR Energy Services Management, LP and GR Energy Services, LLC; Exhibit T U.S. Pat. No. 10,844,697 vs Select-Fire System; dated Aug. 30, 2021; 36 pages.
GR Energy Operating GP LLC, GR Energy Services Management, LP and GR Energy Services, LLC; Exhibit U U.S. Pat. No. 10,844,697 vs New Select-Fire System; dated Aug. 30, 2021; 37 pages.
GR Energy Operating GP LLC, GR Energy Services Management, LP and GR Energy Services, LLC; Exhibit V U.S. Pat. No. 10,844,697 vs EWAPS; dated Aug. 30, 2021; 17 pages.
GR Energy Operating GP LLC, GR Energy Services Management, LP and GR Energy Services, LLC; Exhibit W U.S. Pat. No. 10,844,697 vs SafeJet System; dated Aug. 30, 2021; 17 pages.
GR Energy Operating GP LLC, GR Energy Services Management, LP and GR Energy Services, LLC; GR Energy's Preliminary Invalidity Contentions for Civil Action No. 6:21-cv-00085-ADA; dated Aug. 30, 2021; 18 pages.
GR Energy Services Operating GP LLC, GR Energy Services Management, LP and GR Energy Services, LLC; GR Energy's Opening Claim Construction Brief; dated Oct. 18, 2021; 23 pages.
Guedes, Carlos; Signed Response Authenticating Documents for Civil Action No. 3-20-cv-000376; dated Jul. 13, 2021; 20 pages.
H-1 Perforating Gun System; Exhibit No. 1022 of PGR No. 2021-00089; dated May 1, 2020; 6 pages.
Halliburton Wireline & Perforating; Velocity Perforating System Plug and Play Guns for Pumpdown Operations; dated Mar. 2021; 8 pages.
Hawes, Erik C.; SWM and NexTier Stipulation Letter; dated Jul. 20, 2021; 2 pages.
Heard, Preston; Declaration for PGR2021-00078; dated Aug. 19, 2021; 5 pages.
Horizontal Wireline Services, LLC and Allied Wireline Services, LLC; Defendants' Opening Claim Construction Brief; dated Oct. 18, 2021; 27 pages.
Horizontal Wireline Services, LLC and Allied Wireline Services, LLC; Defendants' Preliminary Invalidity Contentions for Civil Action No. 6:21-cv-00349-ADA; dated Aug. 30, 2021; 22 pages.
Horizontal Wireline Services, LLC and Allied Wireline Services, LLC; Exhibit A1 U.S. Pat. No. 5,155,293 to Barton vs. Asserted Claims of U.S. Pat. No. 10,844,697; dated Aug. 30, 2021; 21 pages.
Horizontal Wireline Services, LLC and Allied Wireline Services, LLC; Exhibit A23 Amit Govil, Selective Perforation: A Game Changer in Perforating Technology—Case Study, 2012 European and West African Perforating Symposium vs. Asserted Claims of U.S. Pat. No. 10,844,697; dated Aug. 30, 2021; 17 pages.
United States Patent and Trademark Office; Non-Final Office Action for U.S. Appl. No. 16/540,484; dated Aug. 9, 2021; 12 pages.
United States Patent and Trademark Office; Non-Final Office Action for U.S. Appl. No. 16/809,729; dated Feb. 3, 2022; 6 pages.
United States Patent and Trademark Office; Non-Final Office Action for U.S. Appl. No. 16/809,729; dated Jun. 22, 2021; 15 pages.
United States Patent and Trademark Office; Non-Final Office Action for U.S. Appl. No. 17/007,574; dated Jan. 29, 2021; 11 pages.
United States Patent and Trademark Office; Non-Final Office Action for U.S. Appl. No. 17/221,219; dated Jun. 17, 2021; 10 pages.
United States Patent and Trademark Office; Non-Final Office Action for U.S. Appl. No. 17/352,728; dated Oct. 25, 2021; 9 pages.
United States Patent and Trademark Office; Non-Final Office Action of U.S. Appl. No. 15/920,800; dated Dec. 9, 2020; 6 pages.
United States Patent and Trademark Office; Notice of Allowability for U.S. Appl. No. 14/908,788; dated Dec. 27, 2017; 5 pages.
United States Patent and Trademark Office; Notice of Allowance for U.S. Appl. No. 15/920,812, mailed Aug. 18, 2020; 5 pages.
United States Patent and Trademark Office; Notice of Allowance for U.S. Appl. No. 16/387,696; issued on Jan. 29, 2020; 7 pages.
United States Patent and Trademark Office; Notice of Allowance for U.S. Appl. No. 14/904,788; dated Jul. 6, 2016; 8 pages.
United States Patent and Trademark Office; Notice of Allowance for U.S. Appl. No. 15/920,812; dated Aug. 4, 2021; 5 pages.
United States Patent and Trademark Office; Notice of Allowance for U.S. Appl. No. 16/423,789; dated Jul. 23, 2020 7 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 16/860,269; dated Apr. 7, 2021; 9 pages.
United States Patent and Trademark Office; Notice of Allowance for U.S. Appl. No. 17/221,219; dated Jan. 13, 2022; 11 pages.
United States Patent and Trademark Office; Notices of Allowabilty for U.S. Appl. No. 16/585,790; dated Jul. 31, 2020 and Mar. 18, 2020; Response to Office Action for U.S. Appl. No. 16/585,790; dated Nov. 12, 2019; 26 pages.
United States Patent and Trademark Office; Office Action and Response to Office Action for U.S. Appl. No. 16/585,790; dated Nov. 12, 2019 and Feb. 12, 2020; 21 pages.
United States Patent and Trademark Office; Office Action for U.S. Appl. No. 17/004,966; dated Dec. 8, 2020; 30 pages.
United States Patent and Trademark Office; Office Action in Ex Parte Reexamination for U.S. Pat. No. 10,844,697; mailed Jan. 26, 2022; 10 pages.
United States Patent and Trademark Office; Office Action of U.S. Appl. No. 16/540,484, dated Aug. 20, 2020, 10 pgs.
United States Patent and Trademark Office; Order Granting Request for Ex Parte Reexamination; dated Nov. 1, 2021; 14 pages.
United States Patent and Trademark Office; Patent Assignment for U.S. Appl. No. 61/733,129; dated Jan. 25, 2013; 2 pages.
United States Patent and Trademark Office; Patent Prosecution History of U.S. Appl. No. 61/733,129; dated Jan. 3, 2013; 22 pages.
United States Patent and Trademark Office; Restriction Requirement for U.S. Appl. No. 17/007,574; dated Oct. 23, 2020; 6 pages.
United States Patent and Trademark Office; Supplemental Notice of Allowability for U.S. Appl. No. 14/904,788; dated Jul. 21, 2016; 2 pages.
United States Patent and Trademark Office; U.S. Appl. No. 61/739,592; dated Dec. 19, 2012; 65 pages.
United States Patent and Trademark Office; U.S. Appl. No. 62/002,559; dated May 23, 2014; 19 pages.
United States Patent and Trademark Office; U.S. Appl. No. 62/002,565; dated Jun. 25, 2014; 25 pages.
United States Patent and Trademark Office; U.S. Appl. No. 62/014,900; dated Jul. 7, 2014; 25 pages.
United States Patent and Trademark Office; U.S. Appl. No. 62/015,014; dated Jul. 7, 2014; 21 pages.
United States Patent and Trademark Office; U.S. Appl. No. 62/015,030; dated Jul. 14, 2014; 29 pages.
United States Patent and Trademark Office; U.S. Appl. No. 62/112,935; dated Feb. 6, 2015; 33 pages.
United States Patent and Trademark Office; U.S. Appl. No. 62/131,324; dated Mar. 24, 2015; 65 pages.
United States Patent and Trademark Office; U.S. Appl. No. 62/621,999; dated Jan. 25, 2018; 42 pages.
United States Patent and Trademark Office; U.S. Appl. No. 62/627,591; dated Feb. 7, 2018; 40 pages.
United States Patent and Trial Appeal Board; Final Written Decision on IPR2018-00600; issued Aug. 20, 2019; 31 pages.
United States Patent Trial and Appeal Board; Decision Denying Institution of Post-Grant Review; PGR No. 2020-00072; dated Jan. 19, 2021; 38 pages.

(56) References Cited

OTHER PUBLICATIONS

United States Patent Trial and Appeal Board; Institution Decision for PGR 2020-00080; dated Feb. 12, 2021; 15 pages.
United States Patent Trial and Appeal Board; Record of Oral Hearing held Feb. 18, 2020 for IPR dated 2018-00600; dated Feb. 18, 2020; 27 pages.
Vigor Petroleum; Perforating Gun Accessories Product Description; https://www.vigordrilling.com/completion-tools/perforating-gun-accessories.html; 2021; 1 page.
Wetechnologies; Downhole Connectors, High Pressure HP / HT & Medium Pressure MP /MT; dated Apr. 3, 2016; http://wetechnologies.com/products/hp-ht-downhole/; 3 pages.
Williams, John; Declaration of Dr. John Williams; dated Oct. 18, 2021; 9 pages.
WIPO, International Search Report for International Application No. PCT/CA2014/050673, mailed Oct. 9, 2014, 3 pgs.
WIPO, Written Opinion of International Searching Authority for PCT Application No. PCT/CA2014/050673, mailed Oct. 9, 2014, 4 pgs.
Wooley, Gary R.; Declaration in Support of Petition for Post Grant Review of U.S. Pat. No. 10,844,697 for PGR2021-00097; dated Jul. 17, 2021; 90 pages.
Wooley, Gary; Declaration of Gary E. Wooley for Civil Action Nos. 6:20-cv-01110-ADA and 6:20-CV-01201-ADA; dated Oct. 18, 2021; 12 pages.
Wooley, Gary; Declaration of Gary R. Wooley for Civil Action No. 3:20-cv-00376; dated Jul. 8, 2021; 11 pages.
Wooley, Gary; Declaration of Gary R. Wooley for Civil Action No. 3:21-cv-00192-M; dated Aug. 17, 2021; 18 bages.
PerfX's Wireline Services, LLC; Exhibit A-7: Invalidity Chart for U.S. Pat. No. 10,844,697 in view of U.S. Pat. No. 9,145,764; dated Aug. 30, 2021; 36 pages.
PerfX's Wireline Services, LLC; Exhibit A-8: Invalidity Chart for U.S. Pat. No. 10,844,697 in view of U.S. Pat. No. 10,077,6414; dated Aug. 30, 2021; 29 pages.
PerfX's Wireline Services, LLC; Exhibit A-9: Invalidity Chart for U.S. Pat. No. 10,844,697 in view of the SafeJet System; dated Aug. 30, 2021; 18 pages.
Preiss Frank et al.; Lowering Total Cost of Operations Through Higher Perforating Efficiency while simultaneously enhancing safety; May 10, 2016; 26 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Claim Construction Declaration for Civil Action No. 3:21-cv-00185; dated Sep. 28, 2021; 41 pages.
Rodgers, John; Claim Construction Declaration for Civil Action No. 3:21-cv-00188; dated Sep. 28, 2021; 42 pages.
Rodgers, John; Declaration for Civil Action No. 3:20-CV-00376; dated Jul. 8, 2021; 32 pages.
Rodgers, John; Declaration for Civil Action No. 3:21-cv-00192-M; dated May 27, 2021; 42 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Rodgers, John; Declaration for PGR2021-00078; dated Aug. 19, 2021; 137 pages.
Rodgers, John; Declaration of John Rodgers, Ph.D for PGR Case No. PGR2021-00097; dated Oct. 28, 2021; 124 pages.
Rodgers, John; Videotaped Deposition of John Rodgers; dated Jul. 29, 2021; 49 pages.
Salt Warren et al.; New Perforating Gun System Increases Safety and Efficiency; dated Apr. 1, 2016; 11 pages.
Salt, et al.; New Perforating Gun System Increases Saftey and Efficiency; Journal of Petroleum Technology; dated Apr. 1, 2016; Weatherford; https://jpt.spe.org/new-perforating-gun-system-increases-safety-and-efficiency; 11 pages.
Scharf Thilo; Declaration for PGR2020-00080; dated Nov. 16, 2020; 16 pages.
Scharf, Thilo; Declaration for PGR2020-00072; dated Oct. 22, 2020; 13 pages.
Schlumberger & Said Abubakr, Combining and Customizing Technologies for Perforating Horizontal Wells in Algeria, Presented at 2011 MENAPS, Nov. 28-30, 2011, 20 pages.
Schlumberger Technology Corporation; Petiton for Post Grant Review Case No. PGR2021-00089; dated Jun. 1, 2021; 155 pages.
Schlumberger; 3.12-in Frac Gun; dated 2007; 2 pages.
Schlumberger; Field Test Database Print Out Showing uses of the SafeJet System; dated May 11, 2015; 10 pages.
Schlumberger; Fractal Flex Multistage stimulation perforating system; dated 2018; 1 page.
Schlumberger; Selective Perforation: A Game Changer in Perforating Technology—Case Study; issued 2012; 14 pages.
Science Direct; Perforating Gun Well-Bore Construction (Drilling and Completions); dated Jul. 20, 2021; 13 pages.
Select Fire System; Exhibit 1028 of PGR 2021-00078; dated 2012; 165 pages.
Shelby Sullivan; Declaration of Shelby Sullivan; dated Oct. 18, 2021; 9 pages.
SIPO, Search Report dated Mar. 29, 2017, in Chinese: See Search Report for CN App. No. 201480040456.9, 12 pgs. (English Translation 3 pgs.).
Smithson, Anthony; Declaration Declaration for IPR2021-00082; dated Oct. 16, 2020; 2 pages.
Smylie, Tom, New Safe and Secure Detonators for the Industry's consideration, presented at Explosives Safety & Security Conference, Marathon Oil Co, Houston; Feb. 23-24, 2005, 20 pages.
State Intellectual Property Office People's Republic of China; First Office Action for Chinese App. No. 201811156092.7; issued Jun. 16, 2020; 6 pages (Eng Translation 8 pages).
State Intellectual Property Office, P.R. China; First Office Action for Chinese App No. 201580011132.7; issued Jun. 27, 2018; 5 pages (Eng. Translation 9 pages).
State Intellectual Property Office, P.R. China; First Office Action for CN App. No. 201480047092.7; issued on Apr. 24, 2017.
State Intellectual Property Office, P.R. China; First Office Action with full translation for CN App. No. 201480040456.9; issued Mar. 29, 2017; 12 pages (English translation 17 pages).
State Intellectual Property Office, P.R. China; Notification to Grant Patent Right for Chinese App. No. 201580011132.7; issued Apr. 3, 2019; 2 pages (Eng. Translation 2 pages).
State Intellectual Property Office, P.R. China; Notification to Grant Patent Right for CN App. No. 201480040456.9; Jun. 12, 2018; 2 pages (English translation 2 pages).
State Intellectual Property Office, P.R. China; Second Office Action for CN App. No. 201480040456.9; issued Nov. 29, 2017; 5 pages (English translation 1 page).
State Intellectual Property Office, P.R. China; Second Office Action for CN App. No. 201480047092.7; issued Jan. 4, 2018; 3 pages.
SWM International, LLC and Nextier Oil Completion Solutions, LLC; Petition for Post Grant Review PGR No. 2021-00097; dated Jul. 20, 2021; 153 pages.
SWM International, LLC; Defendant's P.R. 3-3 and 3-4 Preliminary Invalidity Contentions; dated Aug. 4, 2021; 28 pages.
SWM International, LLC; Defendant's P.R. 4-1 Disclosure of Proposed Terms and Claim Elements for Construction for Civil Action No. 3:21-cv-00192-M; dated Aug. 24, 2021; 5 pages.
SWM International, LLC; Ex. A-1 Invalidity of U.S. Pat. No. 10,844,697 Over the SafeJet System; dated Aug. 4, 2021; 15 pages.
SWM International, LLC; Ex. A-1A Invalidity of U.S. Pat. No. 10,844,697 Over the SafeJet System in view of Backhus; dated Aug. 4, 2021; 4 pages.
SWM International, LLC; Ex. A-1B Invalidity of U.S. Pat. No. 10,844,697 Over the SafeJet System in view of Harrigan; dated Aug. 4, 2021; 3 pages.
SWM International, LLC; Ex. A-2 Invalidity of U.S. Pat. No. 10,844,697 Over Goodman; dated Aug. 4, 2021; 11 pages.
SWM International, LLC; Ex. A-2A Invalidity of U.S. Pat. No. 10,844,697 Over Goodman in view of Backhus; dated Aug. 4, 2021; 3 pages.

(56) References Cited

OTHER PUBLICATIONS

SWM International, LLC; Ex. A-2B Invalidity of U.S. Pat. No. 10,844,697 Over Goodman in view of Harrigan; dated Aug. 4, 2021; 3 pages.
SWM International, LLC; Ex. A-3 Invalidity of U.S. Pat. No. 10,844,697 Over Harrigan; dated Aug. 4, 2021; 13 pages.
SWM International, LLC; Ex. A-4 Invalidity of U.S. Pat. No. 10,844,697 Over Burton; dated Aug. 4, 2021; 11 pages.
SWM International, LLC; Ex. A-5 Invalidity of U.S. Pat. No. 10,844,697 Over Rogman; dated Aug. 4, 2021; 10 pages.
Wooley, Gary; Transcript of Gary Wooley for Civil Action No. 3:21-cv-00192-M; dated Sep. 2, 2021; 26 pages.
Yellow Jacket Oil Tools, LLC; Defendant Yellow Jacket Oil Tools, LLC's Answer to Plaintiffs' First Amended Complaint for Civil Action No. 6:20-cv-01110; dated Aug. 10, 2021; 13 pages.
Yellowjacket Oil Tools, LLC and G&H Diversified Manufacturing, LP; Defendants' Preliminaray Invalidity Contentions for Civil Action No. 6:20-cv-01110-ADA; dated May 6, 2021; 20 pages.
Yellowjacket Oil Tools, LLC and G&H Diversified Manufacturing, LP; Defendants' Preliminary Invalidity Contentions for Civil Action No. 6:20-cv-01110-ADA; dated Aug. 30, 2021; 21 pages.
Yellowjacket Oil Tools, LLC and G&H Diversified Manufacturing, LP; Exhibit A-9 Selective perforation: A Game Changer in Peforating Technology—Case Study; dated Aug. 30, 2021; 13 pages.
Yellowjacket, G&H and Nextier, Invalidity Chart in Litigation re Schlumberger SafeJet, dated as early as Aug. 30, 2021, 13 pgs.
Yellowjacket, G&H and Nextier, Invalidity Chart in Litigation re U.S. Pat. No. 10,844,697, "New Select-Fire System" Publication and Select-Fire System by BakerHughes vs. Asserted Claims, dated as early as Aug. 30, 2021, 33 pgs.
Yellowjacket, G&H and Nextier, Invalidity Chart in Litigation re U.S. Pat. No. 10,844,697, New Select-Fire System vs. Asserted Claims, dated as early as Aug. 30, 2021, 33 pgs.
Yellowjacket, G&H and Nextier, Invalidity Chart in Litigation re U.S. Pat. No. 10,844,697, U.S. Patent Publication No. 2013/0126237 A1 to Burton vs Asserted Claims, dated as early as Aug. 30, 2021, 3 pgs.
Yellowjacket, G&H and Nextier, Invalidity Chart in Litigation re U.S. Pat. No. 10,844,697, U.S. Patent Publication No. 2016 0084048 A1 to Harrigan et al. vs. Asserted Claims, dated as early as Aug. 30, 2021, 4 pgs.
Yellowjacket, G&H and Nextier, Invalidity Chart in Litigation re U.S. Pat. No. 10,844,697, U.S. Appl. No. 61/733,129 vs. Asserted Claims, dated as early as Aug. 30, 2021, 55 pgs.
Yellowjacket, G&H and Nextier, Invalidity Chart in Litigation re U.S. Pat. No. 10,844,697, U.S. Appl. No. 61/819,196 to Harrigan et al. vs. Asserted Claims, dated as early as Aug. 30, 2021, 26 pgs.
Yellowjacket, G&H and Nextier, Invalidity Chart in Litigation re U.S. Pat. No. 10,844,697, US Pub. No. 2012/0247771 vs. Asserted Claims, dated as early as Aug. 30, 2021, 30 pgs.
Yellowjacket, G&H and Nextier, Invalidity Chart in Litigation re U.S. Pat. No. 10,844,697, U.S. Pat. No. 10,077,641 to Rogman vs. Asserted Claims, dated as early as Aug. 30, 2021, 36 pgs.
Yellowjacket, G&H and Nextier, Invalidity Chart in Litigation re U.S. Pat. No. 10,844,697, U.S. Pat. No. 3, 173,229 to Gene T. Boop vs. Asserted Claims, dated as early as Aug. 30, 2021, 12 pgs.
Yellowjacket, G&H and Nextier, Invalidity Chart in Litigation re U.S. Pat. No. 10,844,697, U.S. Pat. No. 4,457,383 to Gene T. Boop vs. Asserted Claims, dated as early as Aug. 30, 2021, 22 pgs.
Yellowjacket, G&H and Nextier, Invalidity Chart in Litigation re U.S. Pat. No. 10,844,697, U.S. Pat. No. 6,506,083 vs. Asserted Claims, dated as early as Aug. 30, 2021, 3 pgs.
Yellowjacket, G&H and Nextier, Invalidity Chart in Litigation re U.S. Pat. No. 10,844,697, U.S. Pat. No. 6,582,251 to Burke et al. vs. Asserted Claims, dated as early as Aug. 30, 2021, 3 pgs.
Yellowjacket, G&H and Nextier, Invalidity Chart in Litigation re U.S. Pat. No. 10,844,697, U.S. Pat. No. 7,226,303 to Shaikh vs. Asserted Claims, dated as early as Aug. 30, 2021, 4 pgs.
Yellowjacket, G&H and Nextier, Invalidity Chart in Litigation re U.S. Pat. No. 10,844,697, U.S. Pat. No. 7,762,331 to Goodman vs. Asserted Claims, dated as early as Aug. 30, 2021, 4 pgs.
Yellowjacket, G&H and Nextier, Invalidity Chart in Litigation re U.S. Pat. No. 10,844,697, U.S. Pat. No. 8,387,533 to Runkel vs. Asserted Claims, dated as early as Aug. 30, 2021, 5 pgs.
Yellowjacket, G&H and Nextier, Invalidity Chart in Litigation re U.S. Pat. No. 10,844,697, U.S. Pat. No. 8,943,943 to Carlos Jose Tassaroli vs. Asserted Patents, dated as early as Aug. 30, 2021, 7 pgs.
Yellowjacket, G&H and Nextier, Invalidity Chart in Litigation re U.S. Pat. No. 10,844,697, U.S. Pat. No. 9,065,201 to Borgfeld et al vs. Asserted Claims, dated as early as Aug. 30, 2021, 3 pgs.
Yellowjacket, G&H and Nextier, Invalidity Chart in Litigation re U.S. Pat. No. 10,844,697, U.S. Pat. No. 9,874,083 to Logan vs. Asserted Claims, dated as early as Aug. 30, 2021, 18 pgs.
Ael Intelligent Blasting, Electronic Delay Detonators, Electronic Initiators, Product Catalogue 2018, 21 pgs., https://www.aelworld.com/application/files/6915/4442/8861/ael-intelligent-blasting-differentitated-products-electronic-delay-detonators.pdf.
Albert, Larry et al.; New Perforating Switch Technology Advances Safety & Reliability for Horizontal Completions; Unconventional Resources Tech. Conference; Jul. 20-22, 2015; 7 pgs.
Amit Govil, Selective Perforation: A Game Changer in Perforating Technology—Case Study, presented at the 2012 European and West African Perforating Symposium, Schlumberger, Nov. 7-9. 2012, 14 pgs.
Austin Powder Company; A—140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
Baumann et al.; Perforating Innovations—Shooting Holes in Performance Models; Oilfield Review, Autumn 2014, vol. 26, Issue No. 3 pp. 14-31; 18 pages.
Bear Manufacturing, LLC; Defendant Bear Manufacturing, LLC's Answer, Affirmative Defenses and Counterclaim in response to Plaintiffs' Complaint for Civil Action No. 3:21-cv-00185-M; dated Mar. 22, 2021; 14 pages.
Bear Manufacturing, LLC; Defendant's Preliminary Invalidity Contentions; dated Aug. 4, 2021; 23 pages.
Bear Manufacturing, LLC; Exhibit A1 U.S. Pat. No. 5,155,293 to Barton vs. Asserted Claims of U.S. Pat. No. 10,844,697; dated Aug. 4, 2021; 21 pages.
Bear Mfg and Oso Perf, Invalidity Contentions in Litigation re Amit Govil, "Selective Perforation: A Game Changer in Perforating Technology—Case Study," 2012 European and West African Perforating Symposium ("EWAPS") vs. Asserted Claims of U.S. Pat. No. 10,844,697, dated as early as Aug. 4, 2021, 17 pgs.
Bear Mfg and Oso Perf, Invalidity Contentions in Litigation re U.S. Pat. No. 9,175,553 to McCann, et al. vs. Asserted Claims of U.S. Pat. No. 10,844,697, dated as early as Aug. 4, 2021, 26 pgs.
Bear Mfg, Oso Perf, Horizontal Wireline and Allied Horizontal, Invalidity Chart in Litigation re U.S. Pat. No. 10,844,697, U.S. Pat. No. 6,506,083 vs. Asserted Claims, dated as early as Aug. 4, 2021, 17 pgs.
Bear Mfg, Oso Perf, Horizontal Wireline and Allied Horizontal, Invalidity Contentions in Litigation re U.S. Pat. No. 10,844,697, "New Select-Fire System" Publication and Select-Fire System by BakerHughes vs. Asserted Claims, dated as early as Aug. 4, 2021, 14 pgs.
Bear Mfg, Oso Perf, Horizontal Wireline and Allied Wireline, Invalidity Chart in Litigation re U.S. Pat. No. 10,844,697, US Pub. No. 2012/0247771 vs. Asserted Claims, dated as early as Aug. 4, 2021, 26 pgs.
Bear Mfg, Oso Perf, Horizontal Wireline and Allied Wireline, Invalidity Contentions in Litigation re "3.12-in Frac Gun" Publication and 3.12-in Frac Gun System by Sclumberger vs. Asserted Claims of U.S. Pat. No. 10,844,697, dated as early as Aug. 4, 2021, 26 pgs.

(56) References Cited

OTHER PUBLICATIONS

Bear Mfg, Oso Perf, Horizontal Wireline and Allied Wireline, Invalidity Contentions in Litigation re Schlumberger SafeJet System vs. Asserted Claims of U.S. Pat. No. 10,844,697, dated as early as Aug. 4, 2021, 26 pgs.
Bear Mfg, Oso Perf, Horizontal Wireline and Allied Wireline, Invalidity Contentions in Litigation re U.S. Publication 2012/0199352 to Lanclos vs. Asserted Claims of U.S. Pat. No. 10,844,697, dated as early as Aug. 4, 2021, 24 pgs.
Bear Mfg, Oso Perf, Horizontal Wireline and Allied Wireline, Invalidity Contentions in Litigation re U.S. Publication No. 2008/0073081 to Frazier, et al vs. Asserted Claims of U.S. Pat. No. 10,844,697, dated as early as Aug. 4, 2021, 33 pgs.
Bear Mfg, Oso Perf, Horizontal Wireline and Allied Wireline, Invalidity Contentions in Litigation re U.S. Publication No. 2010/0065302 to Nesbitt vs. Asserted Claims of U.S. Pat. No. 10,844,697, dated as early as Aug. 4, 2021, 15 pgs.
Bear Mfg, Oso Perf, Horizontal Wireline and Allied Wireline, Invalidity Contentions in Litigation re U.S. Publication No. 2016/0084048 to Harrigan, et al vs. Asserted Claims of U.S. Pat. No. 10,844,697, dated as early as Aug. 4, 2021, 14 pgs.
Bear Mfg, Oso Perf, Horizontal Wireline and Allied Wireline, Invalidity Contentions in Litigation re U.S. Pat. No. 3,173,992 to Boop vs. Asserted Claims of U.S. Pat. No. 10,844,697, dated as early as Aug. 4, 2021, 17 pgs.
Bear Mfg, Oso Perf, Horizontal Wireline and Allied Wireline, Invalidity Contentions in Litigation re U.S. Pat. No. 4,457,383 to Boop. vs. Asserted Claims of U.S. Pat. No. 10,844,697, dated as early as Aug. 4, 2021, 22 pgs.
Bear Mfg, Oso Perf, Horizontal Wireline and Allied Wireline, Invalidity Contentions in Litigation re U.S. Pat. No. 6,582,251 to Burke, et al vs. Asserted Claims of U.S. Pat. No. 10,844,697, dated as early as Aug. 4, 2021, 15 pgs.
Bear Mfg, Oso Perf, Horizontal Wireline and Allied Wireline, Invalidity Contentions in Litigation re U.S. Pat. No. 7,762,331 to Goodman vs. Asserted Claims of U.S. Pat. No. 10,844,697, dated as early as Aug. 4, 2021, 28 pgs.
Bear Mfg, Oso Perf, Horizontal Wireline and Allied Wireline, Invalidity Contentions in Litigation re U.S. Pat. No. 7,901,247 to Ring vs. Asserted Claims of U.S. Pat. No. 10,844,697, dated as early as Aug. 4, 2021, 19 pgs.
Bear Mfg, Oso Perf, Horizontal Wireline and Allied Wireline, Invalidity Contentions in Litigation re U.S. Pat. No. 8,387,533 to Runkel vs. Asserted Claims of U.S. Pat. No. 10,844,697, dated as early as Aug. 4, 2021, 16 pgs.
Bear Mfg, Oso Perf, Horizontal Wireline and Allied Wireline, Invalidity Contentions in Litigation re U.S. Pat. No. 8,869,887 to Deere, et al vs. Asserted Claims of U.S. Pat. No. 10,844,697, dated as early as Aug. 4, 2021, 10 ogs.
Bear Mfg, Oso Perf, Horizontal Wireline and Allied Wireline, Invalidity Contentions in Litigation re U.S. Pat. No. 8,943,943 to Tassaroli vs. Asserted Claims of U.S. Pat. No. 10,844,697, dated as early as Aug. 4, 2021, 7 pgs.
Bear Mfg, Oso Perf, Horizontal Wireline and Allied Wireline, Invalidity Contentions in Litigation re U.S. Pat. No. 9,065,201 to Borgfeld, et al. vs. Asserted Claims of U.S. Pat. No. 10,844,697, dated as early as Aug. 4, 2021, 14 pgs.
Bear Mfg, Oso Perf, Horizontal Wireline and Allied Wireline, Invalidity Contentions in Litigation re U.S. Pat. No. 9,145,764 to Burton, et al. vs. Asserted Claims of U.S. Pat. No. 10,844,697, dated as early as Aug. 4, 2021, 18 pgs.
Bear Mfg, Oso Perf, Horizontal Wireline and Allied Wireline, Invalidity Contentions in Litigation re U.S. Pat. No. 9,689,223 to Schacherer, et al vs. Asserted Claims of U.S. Pat. No. 10,844,697, dated as early as Aug. 4, 2021, 8 pgs.
Brazilian Patent and Trademark Office; Search Report for BR Application No. BR112015033010-0; mailed May 5, 2020; (4 pages).
Brinsden, Mark; Declaration of Mark Brinsden; dated Sep. 30, 2021; 51 pages.
Buche & Associates, P.C.; Rule 501 Citation of Prior Art and Written "Claim Scope Statements" in U.S. Pat. No. 10,844,697; dated Mar. 3, 2021; 24 pages.
Burndy, Bulkhead Ground Connector, Mechanical Summary Sheet, The Grounding Superstore, Jul. 15, 2014, 1 page, https://www.burndy.com/docs/default-source/cutsheets/bulkhead-connect.
Canadian Intellectual Property Office, Office Action for CA App. No. 2923860 dated Jul. 14, 2017, 3 pages.
Canadian Intellectual Property Office, Office Action for CA App. No. 2923860 dated Nov. 25, 2016, 3 pages.
Canadian Intellectual Property Office; Notice of Allowance for CA Appl. No. 2,821,506; mailed Jul. 31, 2019; 1 page.
Canadian Intellectual Property Office; Notice of Allowance for CA Application No. 2,941,648; dated Feb. 2, 2022; 1 page.
Canadian Intellectual Property Office; Office Action for CA Appl. No. 2,821,506; mailed Mar. 21, 2019; 4 pages.
Canadian Intellectual Property Office; Office Action for CA Application No. 2,941,648; dated Jul. 12, 2021; 3 pages.
Canadian Intellectual Property Office; Office Action for CA Application No. 2,941,648; dated Mar. 15, 2021; 3 pages.
Canadian Intellectual Property Office; Office Action for CA Application No. 3,070,118; dated Mar. 16, 2021; 3 pages.
Canadian Intellectual Property Office; Office Action for CA Application No. 3,070,118; dated Nov. 17, 2021; 3 pages.
Canadian Intellectual Property Office; Office Action for CA Application No. 3040648; dated Nov. 18, 2020; 4 pages.
ControlFire User Manual; Exhibit No. 2005 of PGR No. 2020-00072; 2014; 56 pages.
Core Lab, ZERO180 Gun System Assembly and Arming Procedures—MAN-Z180-000 (R09), Jul. 9, 2020, 38 pages.
Corelab Owen Oil Tools; Expendable Perforating Guns Description; https://www.corelab.com/owen/cms/docs/Canada/10A_erhsc-01.0-c.pdf; 2008; 7 pages.
CoreLab Quick Change Assembly; Exhibit No. 1034 of PGR No. 2021-00078; dated Aug. 2002; 1 page.
Tolteq; iSeries MWD System; dated 2021; 9 pages.
U.S. Patent Trial and Appeal Board, Institution of Inter Partes Review of U.S. Pat. No. 9581422, Case IPR2018-00600, Aug. 21, 2018, 9 pages.
United States District Court for the Northern District of Texas Dallas Division; Memorandum Opinion and Order in Civil Action No. 3:21-cv-00192-M; Mar. 23, 2022; 34 pages (order is redacted to protect confidential information; redacted order has not yet been filed by the Court).
United States District Court for the Northern District of Texas Dallas Division; Memorandum Opinion and Order in Civil Action No. 3:21-cv-00188-M; Mar. 23, 2022; 35 pages (order is redacted to protect confidential information; redacted order has not yet been filed by the Court).
United States District Court for the Southern District of Texas; Joint Claim Construction Statement for Civil Action No. 3:20-cv-00376; dated Jul. 8, 2021; 14 pages.
United States District Court for the Southern District of Texas; Joint Claim Construction Statement for Civil Action No. 4:20-cv-02123; dated Aug. 27, 2021; 14 pages.
United States District Court for the Western District of Texas; Order Granting in Part & Denying on Part Defendants' Motion to Dismiss for Improper Venue or to Transfer Venue Pursuant to 28 U.S.C. § 1404(a) for Civil Action No. 6:20-CV-01110-ADA; dated Aug. 5, 2021; 16 pages.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.

(56) References Cited

OTHER PUBLICATIONS

United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.
United States Patent and Trademark Office, Final Office Action of U.S. Appl. No. 16/359,540, dated Aug. 14, 2019, 9 pages.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Non-Final Office Action of U.S. Appl. No. 16/451,440, dated Oct. 24, 2019, 22 pages.
United States Patent and Trademark Office, Non-Final Office Action of U.S. Appl. No. 14/767,058, dated Jul. 15, 2016, 9 pages.
United States Patent and Trademark Office, Non-Final Office Action of U.S. Appl. No. 15/117,228, dated May 31, 2018, 9 pages.
United States Patent and Trademark Office, Non-Final Office Action of U.S. Appl. No. 15/617,344, dated Jan. 23, 2019, 5 pages.
United States Patent and Trademark Office, Non-Final Office Action of U.S. Appl. No. 15/788,367, dated Oct. 22, 2018, 6 pages.
United States Patent and Trademark Office, Non-Final Office Action of U.S. Appl. No. 15/920,800, dated Dec. 27, 2019, 6 pages.
United States Patent and Trademark Office, Non-Final Office Action of U.S. Appl. No. 15/920,812, dated Dec. 27, 2019, 6 pages.
United States Patent and Trademark Office, Non-Final Office Action of U.S. Appl. No. 15/920,812, dated May 27, 2020, 5 pages.
United States Patent and Trademark Office, Non-Final Office Action of U.S. Appl. No. 16/026,431, dated Jul. 30, 2019, 10 pages.
United States Patent and Trademark Office, Non-Final Office Action of U.S. Appl. No. 16/359,540, dated May 3, 2019, 11 pages.
United States Patent and Trademark Office, Non-Final Office Action of U.S. Appl. No. 16/455,816, dated Nov. 5, 2019, 17 pages.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
United States Patent and Trademark Office, U.S. Appl. No. 61/733,129; filed Dec. 4, 2012; 10 pages.
United States Patent and Trademark Office, U.S. Appl. No. 61/819,196; filed May 3, 2013 ; 10 pages.
United States Patent and Trademark Office, US Patent No. US438305A, issued on Oct. 14, 1890 to T.A. Edison, 2 pages.
United States Patent and Trademark Office; Final Office Action of U.S. Appl. No. 16/809,729, dated Nov. 3, 2020; 19 pages.
United States Patent and Trademark Office; Advisory Action Before the Filing of an Appeal Brief for U.S. Appl. No. 16/540,484; mailed on May 19, 2021; 3 pages.
United States Patent and Trademark Office; Decision Granting Institution of Post-Grant Review 35 U.S.C. § 324 for PGR2021-00078; dated Nov. 1, 2021; 87 pages.
United States Patent and Trademark Office; Final Office Action for U.S. Appl. No. 16/540,484; dated Apr. 27, 2022; 12 pages.
United States Patent and Trademark Office; Final Office Action for U.S. Appl. No. 16/540,484; dated Feb. 19, 2021; 12 pages.
United States Patent and Trademark Office; Final Office Action for U.S. Appl. No. 16/809,729; dated Nov. 18, 2021; 16 pages.
United States Patent and Trademark Office; Final Office Action for U.S. Appl. No. 17/221,219; dated Aug. 24, 2021; 14 pages.
United States Patent and Trademark Office; Final Office Action for U.S. Appl. No. 17/352,728; dated Mar. 9, 2022; 9 pages.
United States Patent and Trademark Office; Image for U.S. Pat. No. 9,581,422 as of Aug. 23, 2017.
United States Patent and Trademark Office; Non-Final Office Action for U.S. Appl. No. 15/920,812; dated Feb. 3, 2021; 7 pages.
Dalia Abdallah et al., Casing Corrosion Measurement to Extend Asset Life, Dec. 31, 2013, 14 pgs., https://www.slb.com/-/media/files/oilfield-review/2-casing-corr-2-english.
Djresource, Replacing Signal and Ground Wire, May 1, 2007, 2 pages, http://www.djresource.eu/Topics/story/110/Technics-SL-Replacing-Signal-and-Ground-Wire/.
drillingmatters.org; Definition of "sub"; dated Aug. 25, 2018; 2 pages.
DynaEnergetics Europe GmbH, Oso Perforating, LLC, SWM International, LLC and Bear Manufacturing, LLC; Joint Claim Construction Statement for Northern District of Texas Civil Action Nos. 3:21-cv-00188, 3:21-cv-00192 and 3:21-cv-00185; dated Sep. 28, 2021; 29 pages.
DynaEnergetics Europe GmbH; Complaint and Demand for Jury Trial for Civil Action No. 4:21-cv-00280; dated Jan. 28, 2021; 55 pages.
DynaEnergetics Europe GmbH; Patent Owner's Preliminary Response for PGR2020-00072; dated Oct. 23, 2020; 108 pages.
DynaEnergetics Europe GmbH; Patent Owner's Preliminary Response for PGR2020-00080; dated Nov. 18, 2020; 119 pages.
DynaEnergetics Europe GmbH; Patent Owner's Preliminary Response for PGR2021-00078; dated Aug. 19, 2021; 114 pages.
DynaEnergetics Europe GmbH; Plaintiff's Preliminary Infringement Contentions for Civil Action No. 6:21-cv-01110; dated Jul. 6, 2021; 6 pages.
DynaEnergetics Europe GmbH; Principal and Response Brief of Cross-Appellant for United States Court of Appeals case No. 2020-2163, -2191; dated Jan. 11, 2021; 95 pages.
DynaEnergetics Europe, GmbH; DynaEnergetics' Preliminary Claim Construction and Extrinsic Evidence for Civil Action No. 4:21-cv-00280; dated Aug. 4, 2021; 10 pages.
DynaEnergetics Europe, GmbH; Patent Owner's Preliminary Response for PGR No. 2021-00097; dated Oct. 29, 2021; 110 pages.
DynaEnergetics Europe; Defendants' Preliminary Infringement Contentions for Civil Action No. 3:20-CV-00376; dated Mar. 25, 2021; 22 pages.
DynaEnergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.
DynaEnergetics Europe; Exhibit B Invalidity Claim Chart for Civil Action No. 4:19-cv-01611; dated May 2, 2019; 52 pages.
DynaEnergetics Europe; Exhibit C Invalidity Claim Chart for Civil Action No. 4:17-cv-03784; dated Jul. 13, 2020; 114 pages.
DynaEnergetics Europe; Patent Owner's Preliminary Response for PGR No. 2020-00080; dated Nov. 18, 2020; 119 pages.
DynaEnergetics Europe; Plaintiffs' Local Patent Rule 3-1 Infringement Contentions for Civil Action No. 4:19-cv-01611; dated May 25, 2018; 10 Pages.
DynaEnergetics Europe; Plaintiffs' Pending Motion for Reconsideration for Civil Action No. 4:17-cv-03784; dated Jan. 21, 2021; 4 pages.

(56) References Cited

OTHER PUBLICATIONS

DynaEnergetics Europe; Plaintiffs' Preliminary Claim Constructions and Identification of Extrinsic Evidence Civil Action No. 4:17-cv-03784; dated Aug. 3, 2018; 9 pages.
DynaEnergetics Europe; Plaintiffs' Preliminary Infringement Contentions, Civil Action No. 6:20-cv-00069-ADA; dated Apr. 22, 2020; 32 pages.
DynaEnergetics Europe; Plaintiff's Preliminary Infringment Contentions Civil Action No. 3:21-cv-00192-M; dated Jun. 18, 2021; 15 pages.
DynaEnergetics Europe; Plaintiffs' Reply in Support of Motion to Dismiss and Strike for Civil Action No. 6:20-cv-00069-ADA; dated Apr. 29, 2020; 15 pages.
DynaEnergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.
DynaEnergetics Europe; Plaintiffs' Response to Defendants' Answer to Second Amended Complaint Civil Action No. 6:20-cv-00069-ADA; dated May 26, 2020; 18 pages.
DynaEnergetics exhibition and product briefing; Exhibit 2006 of PGR No. 2020-00072; dated 2013; 15 pages.
DynaEnergetics GmbH & Co. KG, Patent Owner's Response to Hunting Titan's Petition for Inter Parties Review—Case IPR2018-00600, filed Dec. 6, 2018, 73 pages.
DynaEnergetics GmbH & Co. KG; Patent Owner's Precedential Opinion Panel Request for Case IPR2018-00600; Sep. 18, 2019, 2 pg.
DynaEnergetics, DYNAselect Electronic Detonator 0015 SFDE RDX 1.4B, Product Information, Dec. 16, 2011, 1 pg.
DynaEnergetics, DYNAselect Electronic Detonator 0015 SFDE RDX 1.4S, Product Information, Dec. 16, 2011, 1 pg.
DynaEnergetics, DYNAselect Electronic Detonator 0015 TFSFDE RDX 1.4B, Product Information, Apr. 23, 2015, pg.
DynaEnergetics, DYNAselect System, information downloaded from website, Jul. 3, 2013, 2 pages, http://www.dynaenergetics.com/.
DynaEnergetics, Electronic Top Fire Detonator, Product Information Sheet, Jul. 30, 2013, 1 pg.
DynaEnergetics, Gun Assembly, Product Summary Sheet, May 7, 2004, 1 page.
DynaEnergetics, Selective Perforating Switch, information downloaded from website, Jul. 3, 2013, 2 pages, http://www.dynaenergetics.com/.
DynaEnergetics, Selective Perforating Switch, Product Information Sheet, May 27, 2011, 1 pg.
DynaEnergetics, DynaStage Solution—Factory Assembled Performance-Assured Perforating Systems; 6 pages.
DynaStage Gun System; Exhibit 2009 of PGR No. 2020-00080; dated May 2014; 2 pages.
EP Patent Office—International Searching Authority, PCT Search Report and Written Opinion for PCT Application No. PCT/EP2014/065752, mailed May 4, 2015, 12 pgs.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European App. No. 15721178.0; issued Dec. 13, 2016; 2 pages.
European Patent Office; Office Action for EP App. No. 15721178.0; issued Sep. 6, 2018; 5 pages.
Fayard, Alfredo; Declaration of Alfredo Fayard; dated Oct. 18, 2021; 13 pages.
Federal Institute of Industrial Property; Decision of Granting for RU Appl. No. 2016104882/03(007851); May 17, 2018; 15 pages (English translation 4 pages).
Federal Institute of Industrial Property; Decision on Granting a Patent for Invention Russian App. No 2016139136/03(062394); issued Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); issued Feb. 1, 2018; 6 pages (Eng. Translation 4 pages).
G&H Diversified Manufacturing, LP and DynaEnergetics Europe GmbH; Joint Claim Construction Statement for Civil Action No. 3:20-cv-00376; dated Jul. 8, 2021; 14 pages.
G&H Diversified Manufacturing, LP; Defendant G&H Diversified Manufacturing, LP's Answer to Counter—Claim Plaintiffs' Counter-Claims for Civil Action No. 3:20-cv-00376; dated Apr. 19, 2021; 13 pages.
G&H Diversified Manufacturing, LP; Defendant G&H Diversified Manufacturing, LP's Opening Claim Construction Brief; dated Oct. 18, 2021; 25 pages.
United States Patent and Trademark Office; Office Action issued in U.S. Appl. No. 17/738,184 dated Oct. 4, 2023; 11 pages.
United States Patent and Trademark Office; Office Action issued in U.S. Appl. No. 17/951,606 dated Aug. 17, 2023; 12 pages.
United States Patent and Trademark Office; Final Office Action issued in U.S. Appl. No. 17/738,184 dated Apr. 5, 2024; 11 pages.

* cited by examiner

PERFORATING GUN ASSEMBLY

CROSS-REFERENCE TO RELATED APPLICATIONS

This application is a continuation of U.S. application Ser. No. 17/951,606 filed Sep. 23, 2022, which is a continuation of U.S. application Ser. No. 16/540,484 filed Aug. 14, 2019, which is a continuation of U.S. application Ser. No. 16/026,431 filed Jul. 3, 2018 (now U.S. Pat. No. 10,507,433 issued Dec. 17, 2019), which is a continuation of U.S. application Ser. No. 15/117,228 filed Aug. 8, 2016 (now U.S. Pat. No. 10,188,990 issued Jan. 29, 2019), which claims priority to PCT Application No. PCT/US2015/018906 filed Mar. 5, 2015, which claims the benefit of U.S. Provisional Application No. 61/949,939 filed Mar. 7, 2014, each of which is incorporated herein by reference in its entirety. Application Ser. No. 16/540,484 (from which the current application claims continuation priority benefit) is also a continuation-in-part of U.S. patent application Ser. No. 15/920,812 filed Mar. 14, 2018 (now U.S. Pat. No. 11,125,056 issued Sep. 21, 2021), which is a continuation of U.S. patent application Ser. No. 15/617,344 filed Jun. 8, 2017 (now U.S. Pat. No. 10,429,161 issued Oct. 1, 2019), which is a divisional patent application of U.S. patent application Ser. No. 15/287,309 filed Oct. 6, 2016 (now U.S. Pat. No. 9,702,680 issued Jul. 11, 2017), which is a divisional patent application of U.S. patent application Ser. No. 14/904,788 filed Jan. 13, 2016 (now U.S. Pat. No. 9,494,021 issued Nov. 15, 2016), which claims priority to PCT Application No. PCT/CA2014/050673 filed Jul. 16, 2014, which claims priority to Canadian Patent Application No. 2,821,506 filed Jul. 18, 2013, each of which is incorporated herein by reference in its entirety. Priority benefit herein is claimed to all of the above-listed matters. This application is also a continuation of U.S. application Ser. No. 17/738,184 filed May 6, 2022.

FIELD

A device and method for positioning a detonator within a perforating gun assembly is generally described.

BACKGROUND

Hydrocarbons, such as fossil fuels (e.g. oil) and natural gas, are extracted from underground wellbores extending deeply below the surface using complex machinery and explosive devices. Once the wellbore is established by placement of cases after drilling, a perforating gun assembly, or train or string of multiple perforating gun assemblies (as shown for example in FIG. 1A having first and second perforating gun assemblies 71, 72), are lowered into the wellbore, and positioned adjacent one or more hydrocarbon reservoirs in underground formations. The perforating gun has explosive charges, typically shaped, hollow or projectile charges, which are ignited to create holes in the casing and to blast through the formation so that the hydrocarbons can flow through the casing. For example, FIG. 1B illustrates exemplary shaped charges 75 in an exemplary perforating gun assembly. Once the perforating gun(s) is properly positioned, a surface signal actuates an ignition of a fuse, which in turn initiates a detonating cord (as shown for example in FIG. 1B, with exemplary detonating cord 77), which detonates the shaped charges to penetrate/perforate the casing and thereby allow formation fluids to flow through the perforations thus formed and into a production string. The surface signal typically travels from the surface along electrical wires that run from the surface to one or more detonators positioned within the perforating gun assembly.

Assembly of a perforating gun requires assembly of multiple parts, which typically include at least the following components: a housing or outer gun barrel within which is positioned an electrical wire for communicating from the surface to initiate ignition, a percussion initiator and/or a detonator, a detonating cord, one or more charges which are held in an inner tube, strip or carrying device and, where necessary, one or more boosters. Assembly typically includes threaded insertion of one component into another by screwing or twisting the components into place, optionally by use of a tandem adapter. Since the electrical wire must extend through much of the perforating gun assembly, it is easily twisted and crimped during assembly. In addition, when a wired detonator is used it must be manually connected to the electrical wire, which has lead to multiple problems. Due to the rotating assembly of parts, the wires can become torn, twisted and/or crimped/nicked, the wires may be inadvertently disconnected, or even mis-connected in error during assembly, not to mention the safety issues associated with physically and manually wiring live explosives.

According to the prior art and as shown in FIG. 1C, the wired detonator 60 has typically been configured such that wires must be physically, manually connected upon configuration of the perforating gun assembly. As shown herein, the wired detonator 60 typically has three (or more or less) wires, which require manual, physical connection once the wired detonator is placed into the perforating gun assembly. For detonators with a wired integrated switch for selective perforating, the wires typically include at least a signal-in wire 61, a signal-out wire 62 and a ground wire 63. In a typical manual, physical connection, the wires extending along the perforating gun are matched to the wires of the detonator, and an inner metallic portion of one wire is twisted together with an inner metallic portion of the matched wire using an electrical connector cap 64 or wire nut or a scotch-lock type connector.

What is needed is a detonator positioning device capable of positioning a wireless detonator including a spring-contact, single wire (not two or more wires as described above) connection within a perforating gun assembly, particularly a typical perforating gun assembly that has traditionally used a fully-wired detonator.

BRIEF DESCRIPTION

At least an embodiment of a perforating gun assembly may include a housing extending along a first axis, a detonator provided within the housing, and a tool string component coupled to the housing and abutting the detonator. The detonator may be movable between a first position along the first axis relative to the housing and a second position along the first axis relative to the housing.

At least an embodiment of a perforating gun assembly may include a housing extending along a first axis, a movable structure provided within the housing, and a tool string component coupled to the housing and abutting the moveable structure. The movable structure may be movable between a first position along the first axis relative to the housing and a second position along the first axis relative to the housing.

BRIEF DESCRIPTION OF THE FIGURES

A more particular description will be rendered by reference to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to embodiments.

DETAILED DESCRIPTION

Reference will now be made in detail to various embodiments. Each example is provided by way of explanation, and is not meant as a limitation and does not constitute a definition of all possible embodiments.

A detonator is provided that is capable of being positioned or placed into a perforating gun assembly with minimal effort by means of placement/positioning within a detonator positioning device according to an aspect. In an embodiment, the detonator positioning device includes a detonator positioned within the detonator positioning device, wherein the detonator electrically contactably forms an electrical connection with minimal need to manually and physically connect, cut or crimp multiple wires as required in a fully wired electrical connection. Such a wireless detonator has been generally described in commonly assigned DE Application No. 102013109227.6 filed Aug. 26, 2013, which is incorporated herein by reference in its entirety. In other words, the electrical connection is made only by making electrical contact with electrically contactable components as described in greater detail hereinbelow . . . that is by merely physically touching. Thus, as used herein, the term "wireless" means that the detonator itself is not manually, physically connected within the perforating gun assembly as has been traditionally done with wired connections, but rather merely makes electrical contact through various components as described herein to form the electrical connections. Thus, the signal is not being wirelessly transmitted, but is rather being relayed through electrical cables/wiring within the perforating gun assembly through the electrical contacts. In particular, the electrical connection is made through contact between a line-in contact-initiating pin 38 and a line-in portion 20 as described in greater detail below.

Figure 1A:
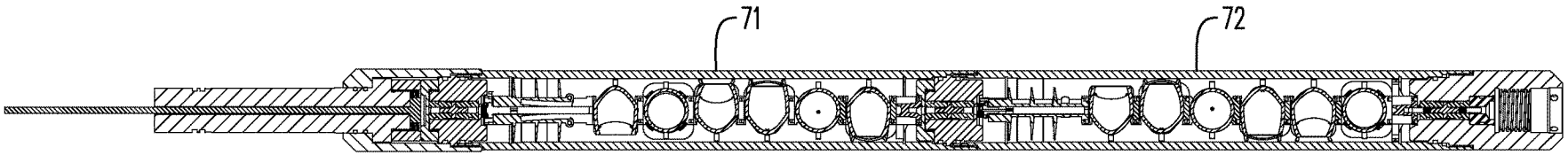
FIG. 1A is a cross-sectional view of a string of exemplary perforating guns, according to an embodiment.
Figure 1B:
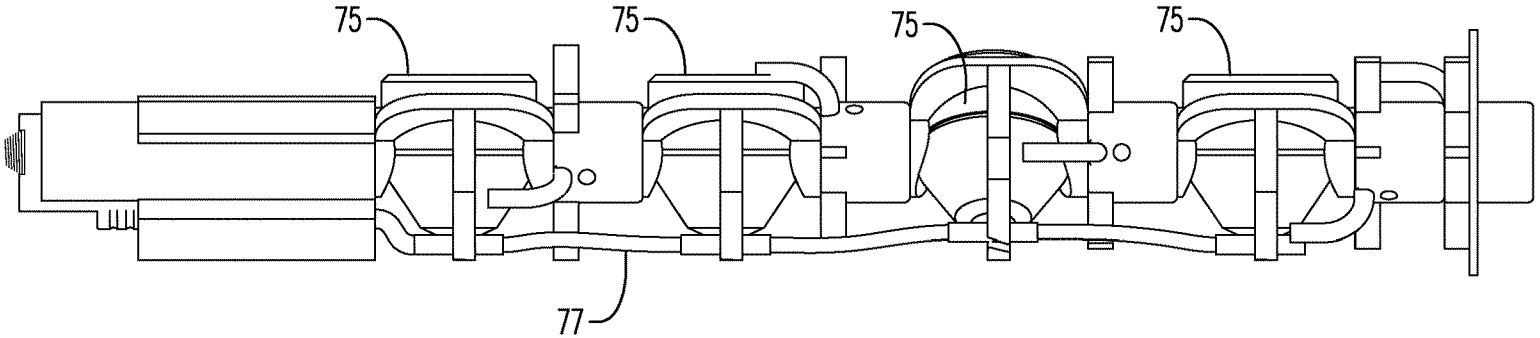
FIG. 1B is a perspective view of an exemplary perforating gun internal assembly, according to an embodiment.
Figure 1C:
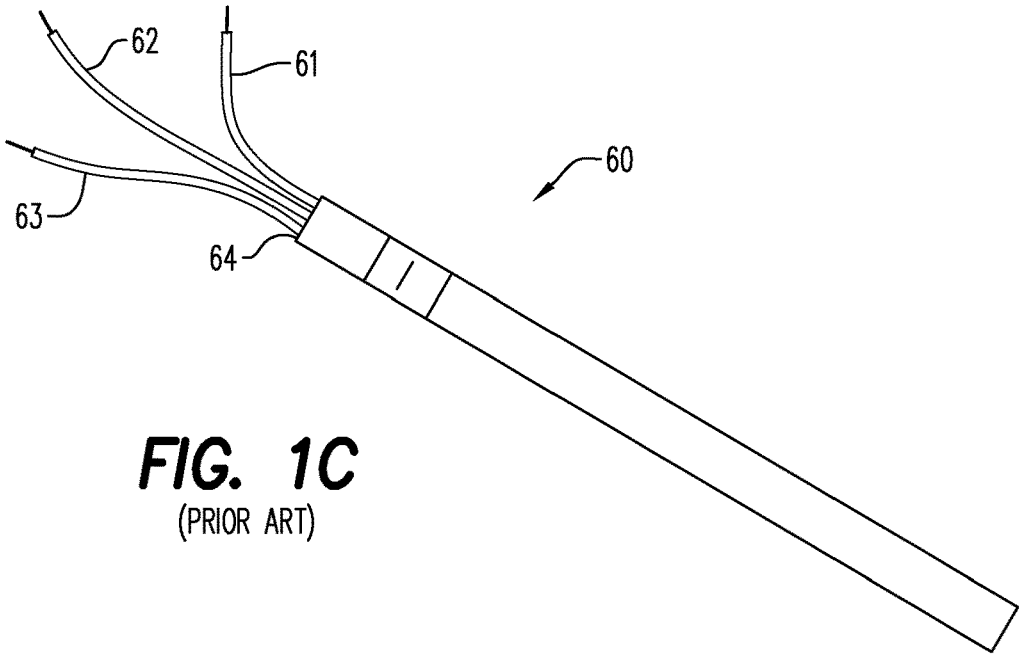
FIG. 1C (PRIOR ART)
FIG. 1C is a perspective view of a wired detonator according to the prior art.
Figure 2:
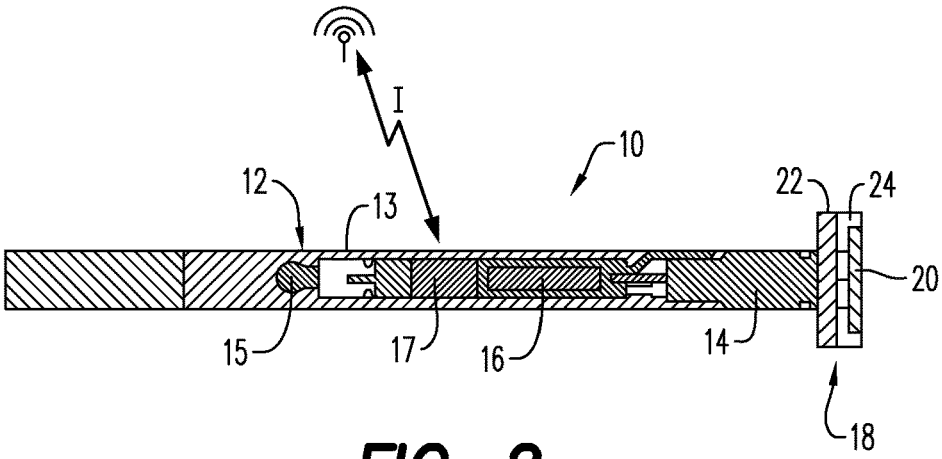
FIG. 2 is a cross-sectional side view of a wireless detonator useful with a detonator positioning device, according to an embodiment.
Figure 3:
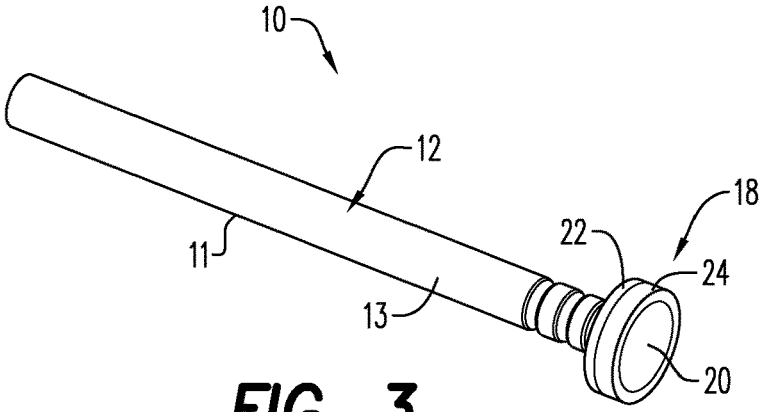
FIG. 3 is a perspective view of the detonator according to FIG. 2.

Now referring to FIGS. 2 and 3 such a detonator 10 incudes a detonator shell 12 and a detonator head 18 and is configured for being electrically contactably received within a perforating gun assembly 40 (see, for instance, FIG. 4) without using a wired electrical connection directly to the detonator. Rather, a single line-out wire (not shown) is connected to the detonator positioning assembly as described in more detail hereinbelow.

Only a portion of the perforating gun assembly 40 is depicted herein, including a perforating gun body or barrel or carrier or housing 42 for housing the various components of the assembly. Also shown is a distal end of a typical tandem seal adapter or tandem sub 44, in which a bulkhead assembly 46 is shown assembled within the perforating gun assembly 40. The tandem sub 44 is configured to seal inner components within the perforating gun housing 42 from the outside environment using sealing means. The tandem seal adapter 44 seals adjacent perforating gun assemblies (not shown) from each other, and houses the bulkhead assembly 46.

Figure 4:
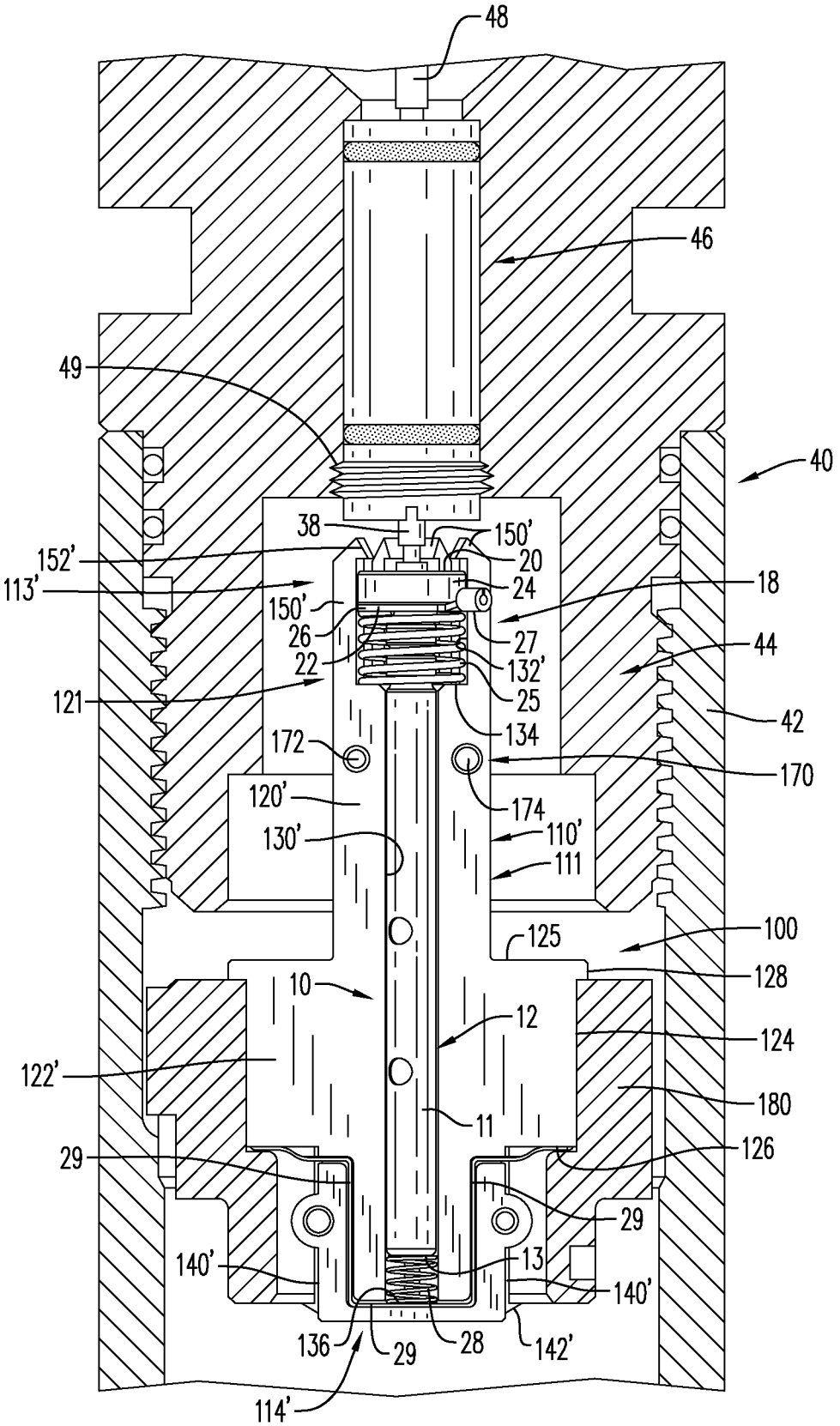
FIG. 4 is a partial semi-cross-sectional side perspective view of a perforating gun assembly including the detonator of FIGS. 2-3 seated within a detonator positioning device in which the detonator positioning device includes a multi-part cylindrical body according to an embodiment.
Figure 5:
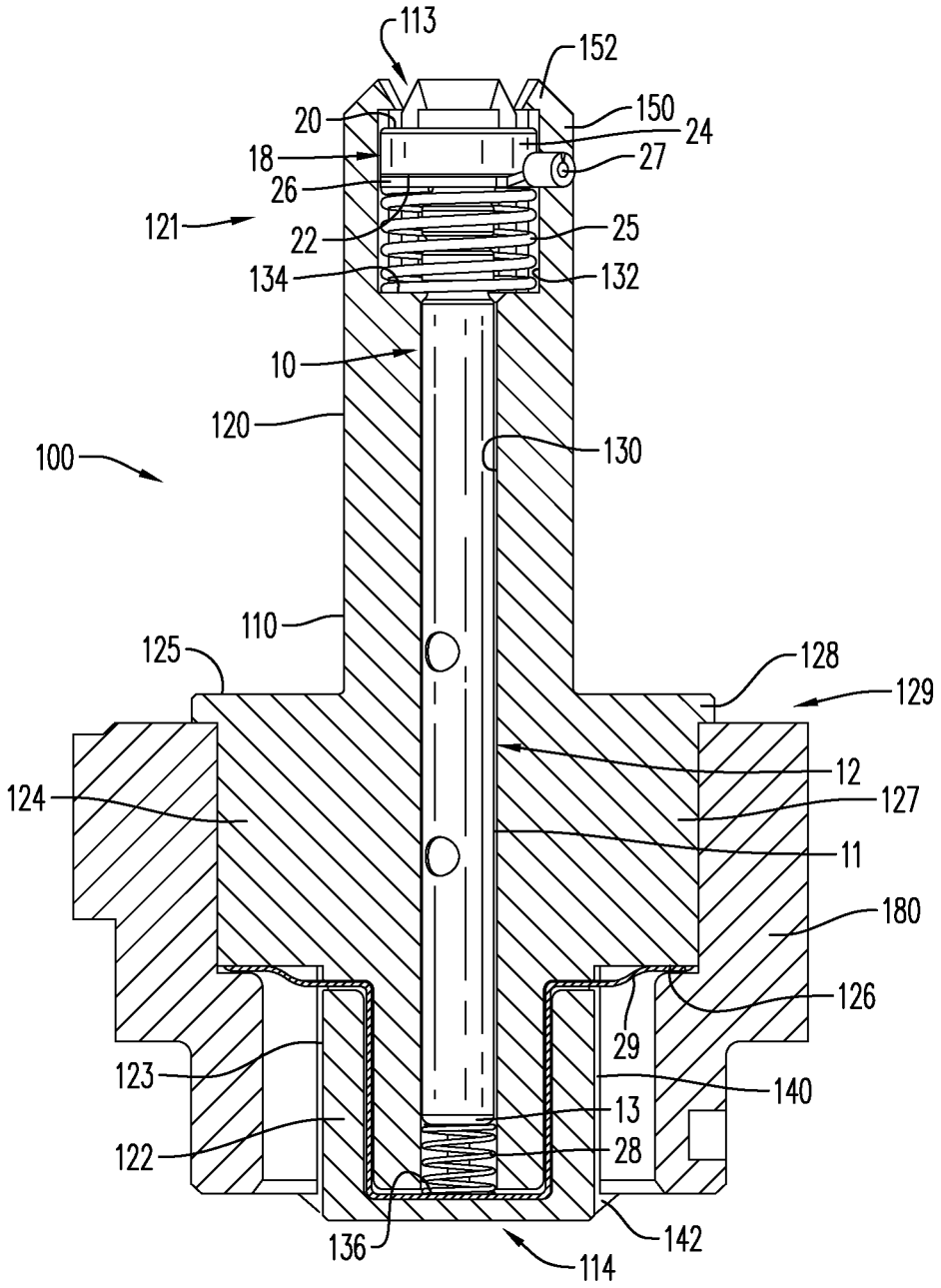
FIG. 5 is a cross-sectional side view of the detonator positioning device formed as a unitary member according to an embodiment.
Figure 10:
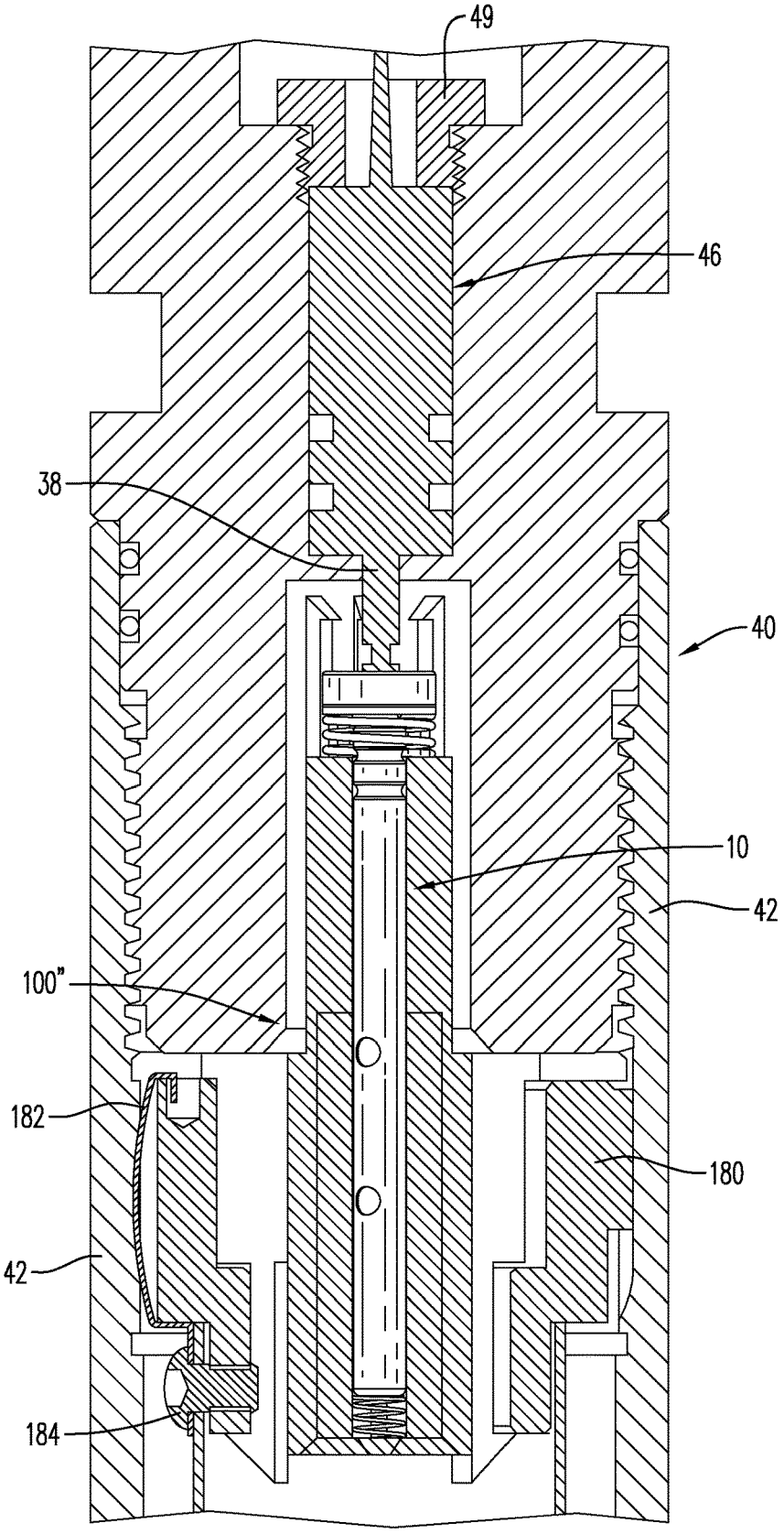
FIG. 10 is a partial cross-sectional view of another embodiment of the detonator positioning device assembly within a perforating gun assembly.

The bulkhead assembly 46 functions to relay a line-in contact-initiating pin 38 for wirelessly electrically contacting a line-in portion 20 of the detonator head 18 as described in greater detail hereinbelow. As shown in FIG. 4, for instance, bulkhead wires 48 are depicted with a coating or insulating member, typically using heat shrinking, over the wires 48 for supplying current to the bulkhead assembly 46. With reference to FIGS. 4 and 10, a bulkhead retaining mechanism 49 is provided to secure the bulkhead assembly 46 within the tandem sub 44. In the embodiment of FIG. 4, the retaining mechanism 49 abuts the end of the bulkhead assembly 46 from which the line-in contact-initiating pin 38 extends, while in the embodiment depicted in FIG. 10, the retaining mechanism 49 abuts the opposite end of the bulkhead assembly 46.

The detonator shell 12 of the detonator 10 useful herein is configured as a housing or casing 11, typically a metallic housing, which houses at least a detonator head plug 14, a fuse head 15, an electronic circuit board 16 and explosive components. The fuse head 15 could be any device capable of converting an electric signal into an explosion. As shown in FIG. 2, the detonator shell 12 is shaped as a hollow cylinder. The electronic circuit board 16 is connected to the fuse head 15 and is configured to allow for selective detonation of the detonator 10. The electronic circuit board 16 is configured to wirelessly and selectively receive an ignition signal I, (typically a digital code uniquely configured for a specific detonator), to fire the perforating gun assembly 40. By "selective" what is meant is that the detonator 10 is configured to receive one or more specific digital sequence(s), which differs from a digital sequence that might be used to arm and/or detonate another detonator in a different, adjacent perforating gun assembly, for instance, a train of perforating gun assemblies. So, detonation of the various assemblies does not necessarily have to occur in a specified sequence. Any specific assembly can be selectively detonated. In an embodiment, the detonation occurs in a bottom-up sequence.

The detonator head 18 extends from one end of the detonator shell 12, and includes more than one electrical contacting component including an electrically contactable line-in portion 20 and an electrically contactable line-out portion 22. According to one embodiment, the detonator head 18 may also include an electrically contactable ground portion 13 (not shown). In an embodiment, the detonator head 18 may be disk-shaped. In another embodiment, at least a portion of the detonator housing 11 is configured as the ground portion 13. The line-in portion 20, the line-out portion 22 and the ground portion 13 are configured to replace the wired connection of the prior art wired detonator 60 and to complete the electrical connection merely by contact with other electrical contacting components. In this way, the line-in portion 20 of the detonator 10 replaces the signal-in wire 61 of the wired detonator 60, the line-out portion 22 replaces the signal-out wire 60 and the ground portion 13 replaces the ground wire 63. Thus, when placed into a detonator positioning device 100 (see, for instance, FIG. 4) as discussed in greater detail below, the line-in portion 20, the line-out portion 22 and the ground portion 13 make an electrical connection by merely making contact with corresponding electrical contacting components (also as discussed in greater detail below). That is, the detonator 10 is wirelessly connectable only by making and maintaining electrical contact of the electrical contacting components to replace the wired electrical connection and without using a wired electrical connection.

The detonator head 18 also includes an insulator 24, which is positioned between the line-in portion 20 and the line-out portion 22. The insulator 24 functions to electrically isolate the line-in portion 20 from the line-out portion 22. Insulation may also be positioned between other lines of the detonator head. As discussed above and in an embodiment, it is possible for all of the contacts to be configured as part of the detonator head 18 (not shown), as found, for instance, in a banana connector used in a headphone wire assembly in which the contacts are stacked longitudinally along a central axis of the connector, with the insulating portion situated between them.

In an embodiment, a capacitor 17 is positioned or otherwise assembled as part of the electronic circuit board 16. The capacitor 17 is configured to be discharged to initiate the detonator 10 upon receipt of a digital firing sequence via the ignition signal I, the ignition signal being electrically relayed directly through the line-in portion 20 and the line-out portion 22 of the detonator head 18. In a typical arrangement, a first digital code is transmitted down-hole to and received by the electronic circuit board. Once it is confirmed that the first digital code is the correct code for that specific detonator, an electronic gate is closed and the capacitor is charged. Then, as a safety feature, a second digital code is transmitted to and received by the electronic circuit board. The second digital code, which is also confirmed as the proper code for the particular detonator, closes a second gate, which in turn discharges the capacitor via the fuse head to initiate the detonation.

In an embodiment, the detonator 10 may be fluid disabled. "Fluid disabled" means that if the perforating gun has a leak and fluid enters the gun system then the detonator is disabled by the presence of the fluid and hence the explosive train is broken. This prevents a perforating gun from splitting open inside a well if it has a leak and plugging the wellbore, as the hardware would burst open. In an embodiment, the detonator 10 is a selective fluid disabled electronic (SFDE) detonator.

The detonator 10 according to an embodiment can be either an electric or an electronic detonator. In an electric detonator, a direct wire from the surface is electrically contactingly connected to the detonator and power is increased to directly initiate the fuse head. In an electronic detonator, circuitry of the electronic circuit board within the detonator is used to initiate the fuse head.

The detonator 10 may be immune to stray current or voltage and/or radiofrequency (RF) signals to avoid inadvertent firing of the perforating gun. Thus, the assembly is provided with means for ensuring immunity to stray current or voltage and/or RF signals, such that the detonator 10 is not initiated through random radio frequency signals, stray voltage or stray current. In other words, the detonator 10 is configured to avoid unintended initiation.

The detonator 10 is configured to be electrically contactingly received within the detonator positioning device 100, which is seated or positioned within the perforating gun assembly 40, without using a wired electrical connection to the detonator 10 itself, as shown in FIGS. 4, 5, 7-9 and 10.

Figure 6:
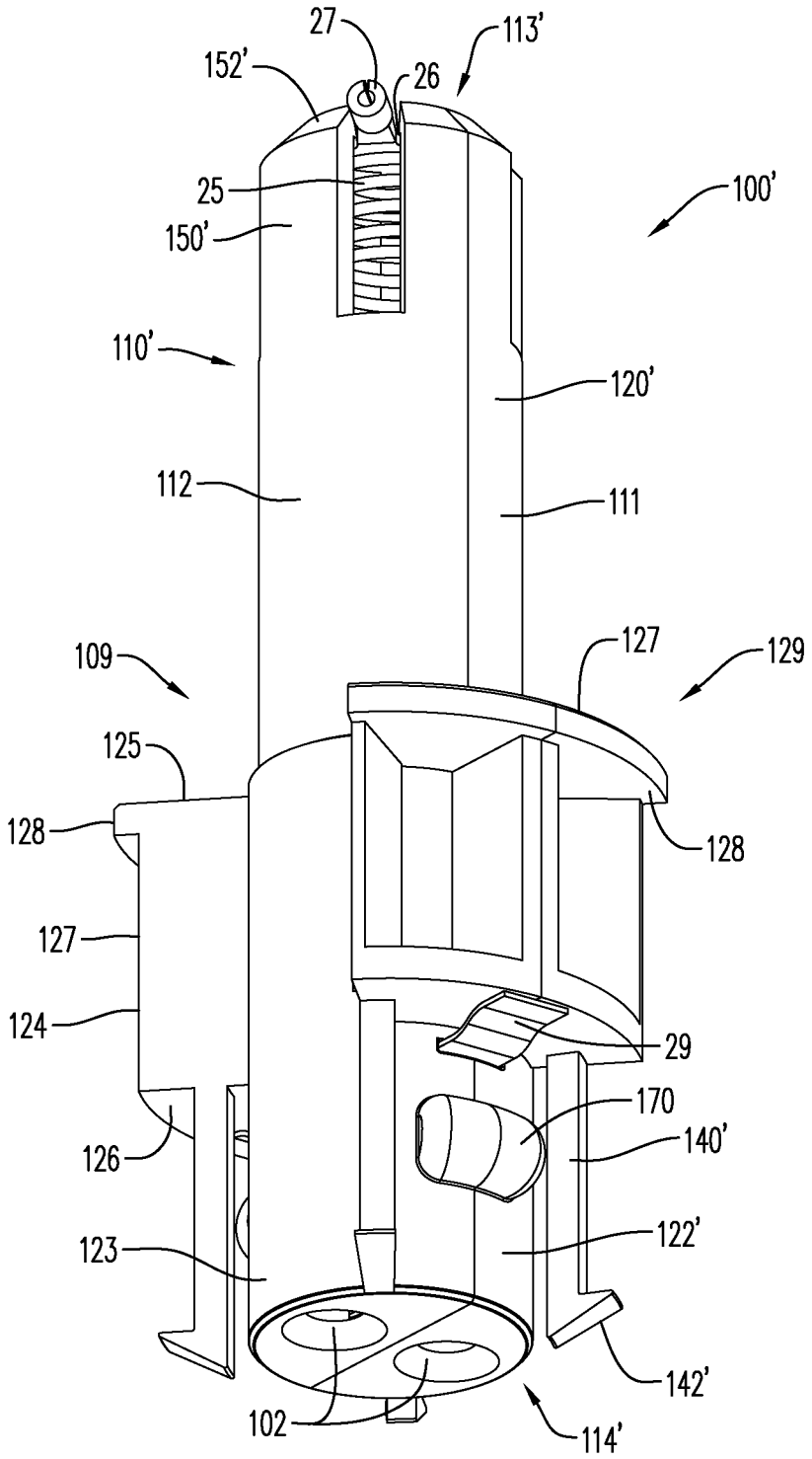
FIG. 6 is a perspective view of the detonator positioning device including a multi-part cylindrical body of FIG. 4 according to an embodiment.
Figure 7:
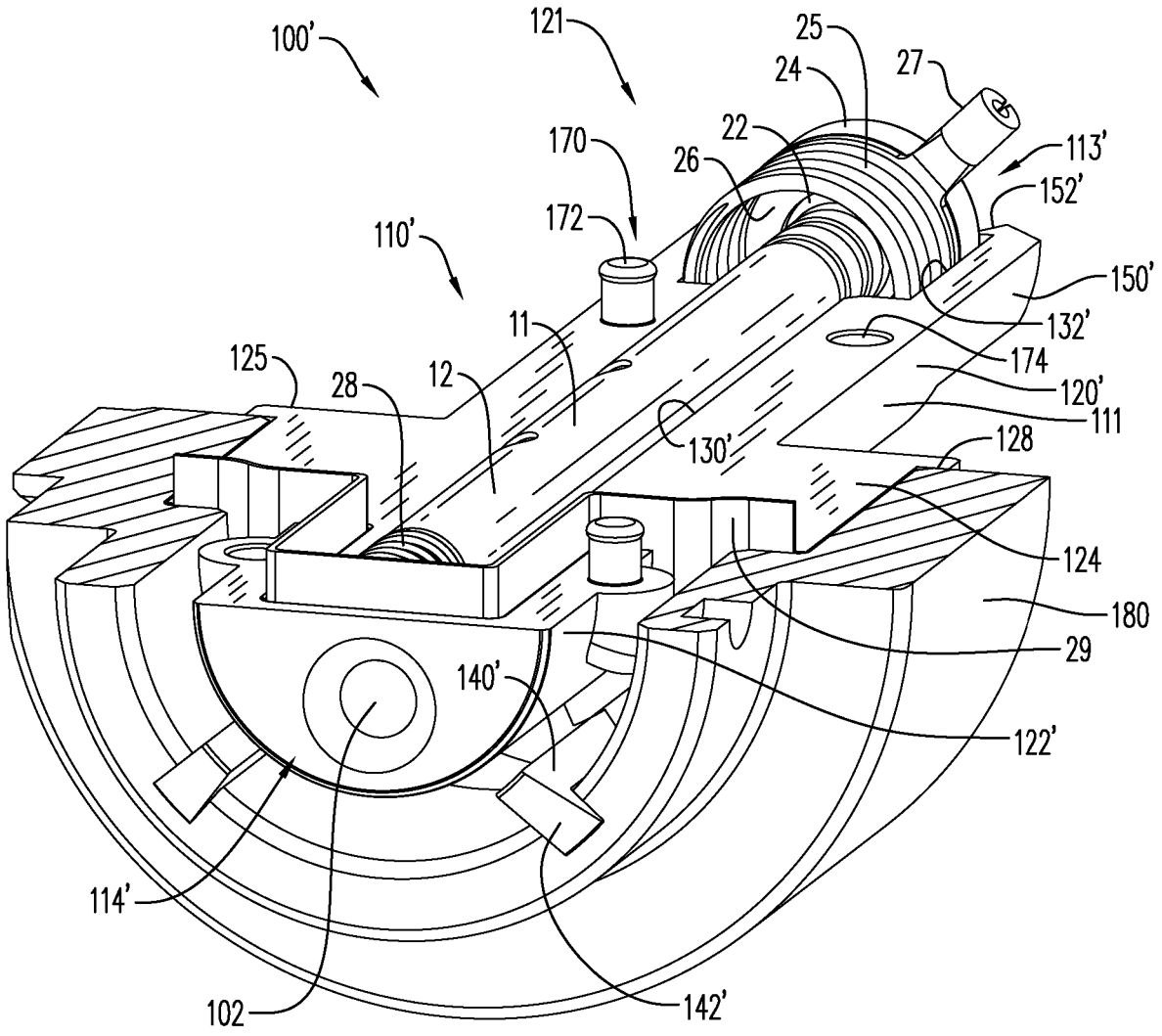
FIG. 7 is a perspective view of one part of the detonator positioning device of FIG. 6 positioned within an end plate according to an embodiment.
Figure 8:
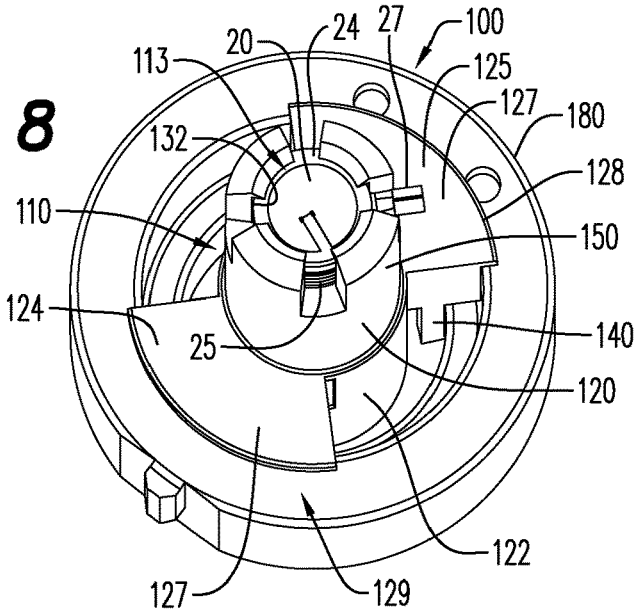
FIG. 8 is a forward end perspective view of the detonator positioning device according to an embodiment.
Figure 9:
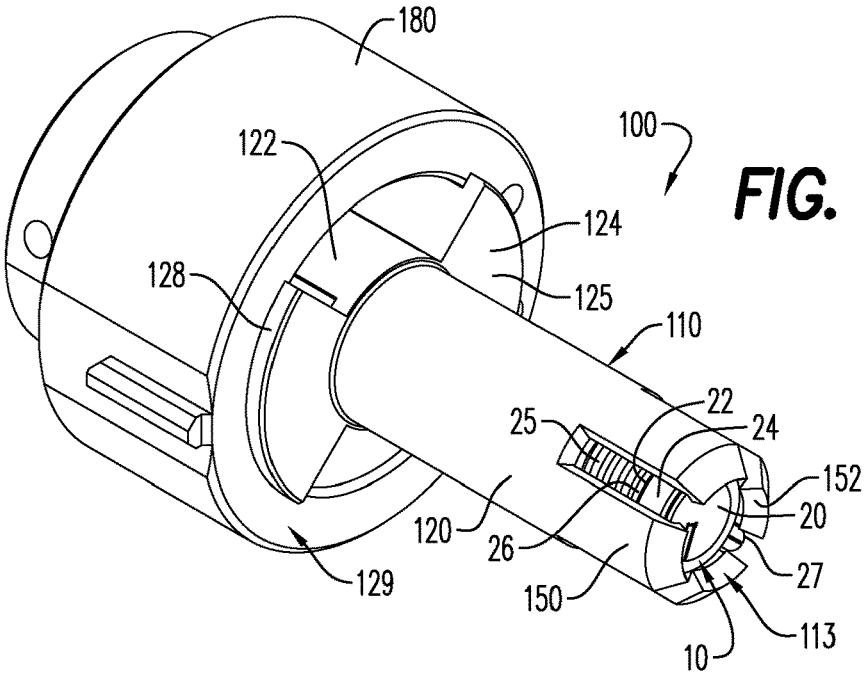
FIG. 9 is another perspective view of the detonator positioning device tilted at an angle from FIG. 8 according to an embodiment.

In an embodiment and as shown in FIGS. 4, 6 and 7, the detonator positioning device 100 includes a cylindrical body 110' depicted as a multi-part member, that is a body that is formed using a plurality of parts or sections, which may facilitate ease of assembly. With reference to the embodiment of FIG. 5, the cylindrical body 110 may also be provided as a unitary body, one that is formed as a whole, for instance by machining or molding processes known by those of ordinary skill in the art. As used herein, the prime symbol ' in the various figures designates the difference between embodiments of the unitary body (no prime used) as compared to features of the multi-part body (prime used), and will not generally be used in the description. As an example, with reference to a central bore 130, the central bore will be depicted as central bore 130' in the embodiment wherein multiple parts are used to form the body 110', while the central bore 130 (without the prime) will be used to depict the bore of the unitary body 100. In an embodiment and with reference to, for instance, FIG. 7, one or more passages 102 are provided in the closed end of the cylindrical body 110 to accommodate passage of a detonating cord (not shown) positioned within the detonator positioning device 100.

With reference again in particular to FIGS. 4-9, the cylindrical body 110 includes an open end 113, a closed end 114, and a central bore 130 adapted for receiving the detonator 10. The cylindrical body 110 also includes a plurality of portions, including at least a first portion 120 and a second portion 122, and in an embodiment a third portion 124, which will be discussed in greater detail below. The central bore 130 extends along at least some of a length of the cylindrical body 110, and typically includes an enlarged bore portion 132 adjacent the open end 113 of the cylindrical body 110. The enlarged bore portion 132 is adapted to receive the head 18 portion of the detonator 10, while the central bore 130 is adapted to receive the housing 11 portion of the detonator 10. In an embodiment, the enlarged bore portion 132 is positioned within the first portion 120 of the cylindrical body 110 and the central bore 130 extends along a majority of the length of the cylindrical body 110. In an embodiment, the enlarged bore portion 132 and the detonator head 18 are complementarily sized and shaped to receive and seat/be received and seated, respectively, in at least a semi-fixed position within the detonator positioning device 100.

In an embodiment, a plurality of arms 150 extend toward the open end 113 of the cylindrical body 110 and at least partially enclose the enlarged bore portion 132 of the central bore 130. In this way, each of the plurality of arms 150 is adapted to retain, hold or otherwise embrace the detonator head 18 portion of the detonator 10 when the detonator 10 is positioned within the enlarged bore portion 132 of the central bore 130. Typically, the arms 150 are made of a flexible and resilient material that is capable of being bent or otherwise moved circumferentially outward, yet return to their original position once the movement force has been removed, (e.g. once the detonator is positioned within the detonator positioning device 100). Thus, the arms 150 will enclose and typically contact at least a peripheral surface of the head 18 of the detonator 10. Although the plurality of arms 150 are depicted as having four arms, it would be understood that more or less arms may be sufficient to perform the stated function, i.e., to retain the detonator head. For instance, the plurality of arms 150 could include 2, 3, 4, 5, 6, 7, 8 or more arms. As shown in FIGS. 4-9 and in an embodiment, the arms may include a retainer 152 positioned at a distal end of the arms to assist in retaining and maintaining the head 18 of the detonator 10 within the detonator positioning device 100. As shown herein, the detonator head 18 is slidably received within the enlarged bore portion 132, meaning the detonator head 18 is capable of sliding along at least a portion of the length of the enlarged bore portion 132 created by the arms 150. In an embodiment, the plurality of arms 150 form at least a portion of a forward end 121 of the first portion 120 of the cylindrical body 110.

Although not shown, it is possible to provide a window or opening in the cylindrical body 110 of the detonator positioning device 100 to facilitate visual verification of proper seating of the detonating cord (not shown), once the detonating cord has been connected to the assembly through the passage 102.

Turning to the other end of the detonator positioning device 100, a plurality of legs 140 are adapted to assist in positioning the device 100 within the perforating gun assembly 40. In the embodiment shown in FIGS. 4-8, the plurality of legs 140 extend from the cylindrical body 110 toward the closed end 114 of the cylindrical body 110. Similar to the arms 150, the legs 140 may be made from a resilient material, and typically include protrusions 142 at the distal ends thereof adapted for positioning and holding the device 100 in place. In an embodiment, each protrusion 142 extends away from the cylindrical body 110.

Although the plurality of legs 140 are depicted as having four legs, it would be understood that more or less legs may be sufficient to perform the stated function, i.e., to position the detonator positioning device within a perforating gun assembly. For instance, the plurality of legs 140 could comprise 3, 4, 5, 6, 7, 8 or more legs. Having more legs (or arms as referenced above) means each individual leg/arm is ultimately thinner than if fewer legs/arms are used. Similarly, thinner legs/arms means the individual legs/arms are less rigid, so there will ultimately be a trade-off in number of legs/arms selected between rigidity and/or flexibility of the detonator positioning device and the ability to stabilize the detonator positioning device within the perforating gun assembly and/or retain the detonator head, as the case may be.

Further, in an embodiment, each of the plurality of arms 150 and the plurality of legs 140 are adapted to provide a snap fit upon insertion of the detonator 10 within the central bore 130 and insertion of the cylindrical body 110 within the perforating gun assembly 40.

As mentioned above, a third portion 124 may also be formed as a portion of the cylindrical body 110. As shown in FIGS. 4-9 and in an embodiment, the third portion 124 is formed integrally as part of the second portion 122, while it is contemplated that the third portion 124 could be formed as a separate unit that is attached to the cylindrically body 110. The third portion 124 has a forward face 125 and a rearward face 126, and as shown in this embodiment, the plurality of legs 140 extend from the rearward face 126 of the third portion 124. As depicted herein, the third portion 124, extends circumferentially from an outer surface 123 of the second portion 122 and the third portion 124 is discontinuous about the outer surface 123 of the second portion 122 of the cylindrical body 110, thus forming a plurality of sections 127. Such an arrangement typically minimized overall weight and associated costs with fabricating the unit, while maintaining sufficient structural integrity to perform the stated functions. Further as depicted in this embodiment, the third portion 124 includes a circumferentially-extending lip 128 at a distal end 129 of the third portion 124. In this arrangement, the distal end 129 is positioned opposite the plurality of legs 140. The lip 128 is further adapted for positioning the detonator positioning device 100 by working in concert with the plurality of legs 140 to hold the detonator positioning device 100 in place within the perforating gun assembly 40.

As stated above, the central bore 130 is adapted to receive and retain the detonator 10, wherein the central bore 130 extends from the open end 113 to the closed end 114 of the cylindrical body 110, and the enlarged bore portion 132 is positioned adjacent the open end 113. Thus, when the detonator 10 is positioned within the central bore 110 of the detonator positioning device 100, the detonator housing 11 extends along a length of the central bore 130, while the detonator head 18 is received within the enlarged bore portion 132.

In an embodiment, a line-out connector biasing member 25 is positioned or otherwise situated within the central bore 130 of the cylindrical body 110, at a base 134 of the enlarged bore portion 132, while a ground connector biasing member 28 is positioned or otherwise situated within the central bore 130 of the cylindrical body 110, at a base 136 of the central bore 130. Thus, the ground connector biasing member 28 is positioned within the central bore 130 between the detonator housing 11 of the detonator 10 and the closed end 114 of the cylindrical body 110. In addition, a terminal 26 is typically positioned adjacent the line-out connector biasing member 25.

In an embodiment, the terminal 26 is formed as a semi-round metallic material, with a slotted nipple 27 extending from an outer circumferential surface of the terminal 26. The slotted nipple 27 is adapted for connection to the single electrical line-out wire needed to complete the electrical connection for this assembly (not shown). Although a slotted nipple 27 is depicted, it will be understood by those of ordinary skill in the art that other mechanisms may be provided to create the electrical connection between the single wire and the terminal 26.

The line-out connector biasing member 25 and the ground connector biasing member 28 may be formed from a spring-like material for assisting in maintenance of physical and electrical contact between the line-in contact-initiating pin 38 extending from the bulkhead assembly 46, and may also be formed of materials suitable to facilitate electrical connectivity. Typically, these components are also metallic, that is to say they are formed from an electrically conductive metal material.

Once received within the central bore 130, therefore, the detonator 10 is electrically contactingly connected to the terminal 26 that is positioned between the line-out portion 22 of the detonating head 18 of the detonator 10 and the line-out connector biasing member 25. Thus, once the detonator 10 is positioned within the central bore 130, and the line-in contact-initiating pin 38 of the bulkhead assembly 46 makes contact with, and thus electrically contactably connects to the line-in portion 20 of the detonator head 18. The line-out connector biasing member 25 will thus compress, causing the line-out portion 22 of the detonator head 18 to electrically contactably connect with the terminal 26. The grounding connection will be discussed in more detail hereinbelow.

With reference to the closed end 114 of the detonator positioning device 100 and in an embodiment, a grounding strip or wire 29 is provided for completing the electrical connection and is also typically formed from an electrically conductive metal material. In an embodiment, the grounding strip 29 is embedded in the closed end 114 of the cylindrical body 110. As shown in the embodiment of FIGS. 4-7, the grounding strip 29 extends from one side of the cylindrical body 110 through to the opposite side of the cylindrical body 110 in a way that a central portion of the grounding strip 29 is positioned adjacent one end of the ground connector biasing member 28, opposite from the housing 11 of the detonator 10. Thus, the ends of the grounding strip 29 extend beyond the outer surface of the cylindrical body 110. When the detonator 10 is positioned within the central bore 130 of the detonator positioning device 100, and the detonator 10 is compressed by the contact of the bulkhead assembly 44, the ground connector biasing member 28 compresses and electrically contactably connects the ground portion 13 of the housing 11 with the ground connector biasing member 28 and the grounding strip 29, which completes a ground loop via connection with the perforating gun housing 42. As shown in FIG. 4, the grounding strip is deformed upon insertion of the detonator positioning device 100 into an end plate 180, the entire assembly of which is inserted within the perforating gun body 42, thus completing the ground loop/connection.

As mentioned above, and with particular reference to FIGS. 4, 6 and 7, the cylindrical body 110 may be formed as a multi-part cylindrical body 110' including at least a first part 111 and a second part 112. As shown herein, the first part 111 of the cylindrical body 110 can be removably connected, (or otherwise joined, fastened, united) to the second part 112 of the cylindrical body 110' to form an assembled cylindrical body 109. In this way, each of the first part 111 and the second part 112 include at least a first portion 120' and a second portion 122', the assembled cylindrical body 109 comprising an open end 113', a closed end 114', and a central bore 130' adapted for receiving the detonator 10, the central bore 130' extending along at least some of a length of the assembled cylindrical body 109, the central bore 130' including an enlarged bore portion 132' adjacent the open end 113' of the assembled cylindrical body 109. In this embodiment, a plurality of arms 150' extend toward the open end 113' of the assembled cylindrical body 109 and at least partially enclose the enlarged bore portion 132' of the central bore 130'. Further, each of the plurality of arms 150' include a retainer 152' adapted to retain the detonator head 18 of the detonator 10 positioned within the enlarged bore portion 132' of the central bore 130'. In an embodiment, a plurality of legs 140' extend from the assembled cylindrical body 109 and toward the closed end 114' of the assembled cylindrical body 109, and each of the plurality of legs 140' include a protrusion 142' extending away from the assembled cylindrical body 109 and adapted for positioning the assembled cylindrical body 109 in the perforating gun assembly 40.

Since the assembled cylindrical body 109 according to this embodiment requires assembly in the field, a plurality of couplers 170 are provided that are adapted for attaching the first part 111 of the assembled cylindrical body 109 to the second part 112 of the assembled cylindrical body 109. It would be understood by one of ordinary skill in the art that it is possible to attach the first part 111 to the second part 112 by any number of fasteners 172, including screws, bolts/nuts and the like that may be received in a socket or cavity 174 through threading, frictional fit and the like. As shown best in FIG. 7 and in an embodiment, the fastener 172 is a protrusion including a distal nob extending from the first part 111, which is matingly inserted into an oppositely positioned cavity 174 of the second part 112 (not shown). In an embodiment, the fastener 172 snap fits into the cavity 174.

In an embodiment, the first part 111 and the second part 112 may be configured as symmetrical or non-symmetrical halves.

According to an aspect the perforating gun assembly 40 and a method for assembling the perforating gun assembly 40 including a wireless detonator 10 and detonator positioning device 100 as described hereinabove is provided.

In an aspect, the method of assembling the perforating gun assembly 40 while using a semi-wired electrical connection includes at least the following steps: positioning the detonator positioning device 100 within the perforating gun assembly 40, the detonator positioning device 100 including the central bore 130; positioning the ground connector biasing member 28 at the base 136 of the central bore 130; positioning the line-out connector biasing member 25 at the base 134 of the enlarged portion 132 of the central bore 130; positioning the terminal 26 for receiving the single line-out wire adjacent the line-out connector biasing member 25; positioning the wireless detonator 10 within the central bore 130 such that the housing 11 of the detonator 10 extends along at least a portion of the central bore 130 and the ground portion 13 of the housing 11 electrically contacts the ground connector biasing member 28, and positioning the head 18 of the detonator 10 within the enlarged portion 132 of central bore 130 such that the line-out portion 22 of the detonator 10 electrically contacts the terminal 26, and the line-in contact-initiating pin 38 electrically contacts the line-in portion 20 of the detonator 10.

According to an aspect, the step of positioning the detonator positioning device 100 within the perforating gun assembly 40 includes positioning the detonator positioning device within a support member or end plate 180, as seen, for instance, FIGS. 4, 5 and 7-10, and as discussed briefly above. As shown herein the end plate 180 has an inner cavity that is sufficiently sized to receive the closed end 114 of the cylindrical body 110, and in particular to receive at least the second portion 122 (and/or the third portion 124) by interlocking and/or snap-fit action with the plurality of legs 140 at a rearward end of the endplate 180 (see FIGS. 4, 5 and 7) and by abutting the circumferentially-extending lip against the outer surface of the end plate 180 (see in particular FIGS. 8 and 9) at the opposite end of the end plate 180. Similarly, the outer dimension or exterior surface of the end plate 180 is sufficiently sized to be received within the perforating gun barrel 42. Although not specifically shown, it will be understood by one of ordinary skill in the art that it is possible to form various members and components described herein as integrated units.

Figure 11:
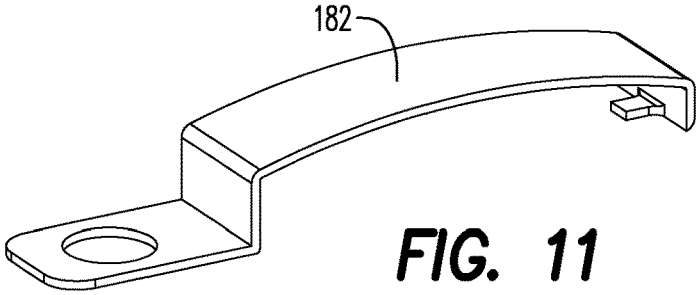
FIG. 11 is a perspective view of a ground rib according an embodiment.

Turning to the embodiment found in FIG. 10, a separate component is provided to facilitate the ground loop discussed hereinabove. As shown herein, a grounding rib 182 is attached to the exterior surface of the end plate 180 to complete the ground loop upon positioning of the detonator positioning device 100 within the perforating gun assembly 40. In an embodiment, the grounding rib 182 is formed as a long, narrow, thin, semi-curved, flexible and resilient, metallic member, as seen best in FIG. 11. As shown herein, a securing mechanism 184 is provided for attaching the grounding rib 182 to the exterior surface of the end plate 180. Thus, when the assembly is inserted into the perforating gun barrel 42, the grounding rib 182 is flexed circumferentially inwardly to complete the ground loop.

As used herein, "hold" means to enclose within bounds, to limit or hold back from movement or to keep in a certain position. The detonator positioning device 100 is positioned within the perforating gun assembly 40 and functions to receive and hold in place the detonator 10 according to an embodiment. In addition, the detonator positioning device 100 also functions to provide electrical contacting components for wirelessly-connectably electrically receiving the detonator 10, while providing for a single wired connection to the detonator positioning device 100 itself.

The components and methods illustrated are not limited to the specific embodiments described herein, but rather, features illustrated or described as part of one embodiment can be used on or in conjunction with other embodiments to yield yet a further embodiment. It is intended that the device and method include such modifications and variations. Further, steps described in the method may be utilized independently and separately from other steps described herein.

While the device and method have been described with reference to a preferred embodiment, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment," "some embodiments," "an embodiment" and the like are not intended to be interpreted as excluding the existence of additional embodiments that also incorporate the recited features. Terms such as "first," "second," "forward," "rearward," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples to disclose the device and method, including the best mode, and also to enable any person of ordinary skill in the art to practice the device and method, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A perforating gun assembly comprising:

a housing;

a detonator provided within the housing;

a detonating cord provided within the housing;

a bias member provided in the housing; and a tandem sub or a tandem seal adapter coupled to the housing;

wherein a relative configuration of the detonator and the detonating cord is movable between a first configuration in which there is a first distance between the detonator and the detonating cord and a second configuration in which there is a second distance between the detonator and the detonating cord;

wherein the second distance is smaller than the first distance;

wherein the bias member biases the relative configuration of the detonator and the detonating cord to the first configuration; and wherein the tandem sub or tandem seal adapter is configured to provide a force opposite to the biasing of the bias member sufficient to transition the relative configuration of the detonator and the detonating cord from the first configuration to the second configuration.

2. The perforating gun assembly of claim 1, wherein the bias member is a spring.

3. The perforating gun assembly of claim 1, further comprising a detonator holder provided within the housing, wherein the detonator is received within the detonator holder.

4. The perforating gun assembly of claim 3, wherein the detonator holder comprises a passage configured to receive an end of the detonating cord.

5. The perforating gun assembly of claim 1, further comprising a shaped charge holder provided within the housing, wherein the detonating cord is coupled to the shaped charge holder.

6. A perforating gun assembly comprising:

a housing extending along a first axis;

a fixed structure provided within the housing and comprising a first explosive, the fixed structure being in a fixed position relative to the housing;

a movable structure provided within the housing and comprising a second explosive, the movable structure being movable between a first position along the first axis relative to the housing and a second position along the first axis relative to the housing;

a bias member configured to exert a biasing force on the movable structure in a first direction along the first axis toward the first position; and a tandem sub or tandem seal adapter coupled to the housing;

wherein, in the first position, there is a first distance between a center of the fixed structure and a center of the movable structure;

wherein in the second position, there is a second distance between the center of the fixed structure and the center of the movable structure;

wherein the second distance is smaller than the first distance; and wherein the tandem sub or tandem seal is configured to provide a force opposite to the biasing force sufficient to transition the movable structure from the first position to the second position.

7. The perforating gun assembly of claim 6, wherein the movable structure is a detonator.

8. The perforating gun assembly of claim 6, wherein the bias member is a spring.

9. The perforating gun assembly of claim 6, wherein the fixed structure is a detonator holder.

10. The perforating gun assembly of claim 9, wherein the moveable structure is a detonator received within the detonator holder.

11. The perforating gun assembly of claim 10, wherein the first explosive is a detonating cord and an end of the detonating cord is received in a passage formed in the detonator holder.

12. The perforating gun assembly of claim 6, wherein one of the first explosive and the second explosive is at least a portion of a detonating cord.

13. A perforating gun assembly comprising:

a housing;

a detonator provided within the housing;

a detonating cord passage provided within the housing;

a bias member provided in the housing; and a tandem sub or a tandem seal adapter coupled to the housing;

wherein a relative configuration of the detonator and the detonating cord passage is movable between a first configuration in which there is a first distance between the detonator and the detonating cord passage and a second configuration in which there is a second distance between the detonator and the detonating cord passage;

wherein the second distance is smaller than the first distance; and wherein the bias member biases the relative configuration of the detonator and the detonating cord passage to the first configuration; and wherein the tandem sub or tandem seal adapter is configured to provide a force opposite to the biasing of the bias member sufficient to transition the relative configuration of the detonator and the detonating cord passage from the first configuration to the second configuration.

14. The perforating gun assembly of claim 13, further comprising a detonator holder provided within the housing, wherein the detonator is received within the detonator holder.

15. The perforating gun assembly of claim 13, further comprising a detonating cord, wherein an end of the detonating cord is received within the detonating cord passage.

16. The perforating gun assembly of claim 13, further comprising:

a shaped charge holder provided within the housing; and a detonating cord, wherein the detonating cord is coupled to the shaped charge holder.

* * * * *